US010998655B2

(12) United States Patent
Minai et al.

(10) Patent No.: US 10,998,655 B2
(45) Date of Patent: May 4, 2021

(54) CONNECTOR AND CONNECTION SYSTEM

(71) Applicant: PANASONIC INTELLECTUAL PROPERTY MANAGEMENT CO., LTD., Osaka (JP)

(72) Inventors: Yuki Minai, Mie (JP); Yoji Miyazaki, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 259 days.

(21) Appl. No.: 16/095,519

(22) PCT Filed: Apr. 18, 2017

(86) PCT No.: PCT/JP2017/015527
§ 371 (c)(1),
(2) Date: Oct. 22, 2018

(87) PCT Pub. No.: WO2017/188054
PCT Pub. Date: Nov. 2, 2017

(65) Prior Publication Data

US 2020/0358212 A1 Nov. 12, 2020

(30) Foreign Application Priority Data

Apr. 28, 2016 (JP) ..... JP2016-091929
Apr. 28, 2016 (JP) ..... JP2016-091930
(Continued)

(51) Int. Cl.
*H01R 12/00* (2006.01)
*H01R 12/71* (2011.01)
(Continued)

(52) U.S. Cl.
CPC ..... *H01R 12/71* (2013.01); *H01R 12/52* (2013.01); *H01R 12/57* (2013.01);
(Continued)

(58) Field of Classification Search
CPC ..... H01R 23/725; H01R 23/7063; H01R 23/7073
(Continued)

(56) References Cited

U.S. PATENT DOCUMENTS 5,167,528 A 12/1992 Nishiyama et al.
5,697,799 A * 12/1997 Consoli ..... H01R 12/716 439/181
(Continued)

FOREIGN PATENT DOCUMENTS

CN 105322319 2/2016
EA 1739796 1/2007
(Continued)

OTHER PUBLICATIONS

Written Opinion issued in PCT/JP2017/015527, dated Jul. 18, 2018, along with an English translation thereof.
(Continued)

*Primary Examiner* — Thanh Tam T Le
(74) *Attorney, Agent, or Firm* — Greenblum & Bernstein, P.L.C.

(57) ABSTRACT

A connector includes contacts, a housing and a mounting metal fitting. The mounting metal fitting possesses a joined section to be joined to a substrate. The joined section is exposed from a back surface of the housing. Each of the contacts possesses an exposed section exposed from the back surface of the housing. The housing possesses a protrusion and a recess. The protrusion is provided between the joined section and at least part of the exposed sections of the contacts, and protrudes from the back surface. The recess
(Continued)

is provided between the protrusion and at least part of the exposed sections of the contacts, and is set lower than an end face of the protrusion to face the substrate.

14 Claims, 18 Drawing Sheets

(30) Foreign Application Priority Data

Dec. 27, 2016 (JP) ..... JP2016-254528
Dec. 27, 2016 (JP) ..... JP2016-254529

(51) Int. Cl.

| | |
|---|---|
| ***H01R 13/6595*** | (2011.01) |
| ***H01R 12/57*** | (2011.01) |
| ***H01R 13/639*** | (2006.01) |
| ***H01R 12/52*** | (2011.01) |
| ***H01R 12/70*** | (2011.01) |
| ***H01R 13/20*** | (2006.01) |
| ***H01R 13/627*** | (2006.01) |
| ***H01R 13/64*** | (2006.01) |
| ***H01R 13/6591*** | (2011.01) |
| ***H01R 24/60*** | (2011.01) |
| ***H01R 24/78*** | (2011.01) |
| *H01R 13/6582* | (2011.01) |

(52) U.S. Cl.
CPC ..... *H01R 12/7029* (2013.01); *H01R 12/716* (2013.01); *H01R 13/20* (2013.01); *H01R 13/6273* (2013.01); *H01R 13/6275* (2013.01); *H01R 13/639* (2013.01); *H01R 13/64* (2013.01); *H01R 13/6591* (2013.01); *H01R 13/6595* (2013.01); *H01R 24/60* (2013.01); *H01R 24/78* (2013.01); *H01R 13/6582* (2013.01)

(58) Field of Classification Search
USPC ..... 439/74, 570, 660
See application file for complete search history.

(56) References Cited

U.S. PATENT DOCUMENTS

| | | | | |
|---|---|---|---|---|
| 5,931,689 | A | 8/1999 | Patel | |
| 6,000,968 | A | 12/1999 | Hagiwara | |
| 6,086,416 | A * | 7/2000 | Choy | H01R 12/707 439/567 |
| 6,152,765 | A * | 11/2000 | Tang | H01R 12/7029 439/567 |
| 6,824,425 | B2 * | 11/2004 | Fan | H01R 12/7047 439/570 |
| 7,425,158 | B2 * | 9/2008 | Ookura | H01R 12/52 439/660 |
| 7,465,171 | B2 * | 12/2008 | Miyazaki | H01R 13/20 439/74 |
| 7,540,770 | B2 * | 6/2009 | Ishizuka | H01R 12/7005 439/353 |
| 7,670,174 | B2 * | 3/2010 | Yuan | H01R 12/716 439/570 |
| 7,717,719 | B2 * | 5/2010 | Miyazaki | H01R 13/20 439/74 |
| 7,722,408 | B2 * | 5/2010 | Miyazaki | H01R 12/716 439/660 |
| 7,850,486 | B2 * | 12/2010 | Zhu | H01R 12/707 439/570 |
| 8,052,457 | B2 * | 11/2011 | Miyazaki | H01R 13/6275 439/357 |
| 8,272,881 | B2 * | 9/2012 | Miyazaki | H01R 12/716 439/74 |
| 9,153,892 | B2 * | 10/2015 | Tanaka | H01R 13/6275 |
| 9,300,064 | B2 * | 3/2016 | Takenaga | H01R 13/6582 |
| 9,350,097 | B2 * | 5/2016 | Yunoki | H01R 12/716 |
| 9,425,526 | B2 * | 8/2016 | Uratani | H01R 13/6473 |
| 9,484,648 | B2 * | 11/2016 | Takenaga | H01R 13/405 |
| 9,543,675 | B1 * | 1/2017 | Takenaga | H01R 12/716 |
| 9,620,874 | B2 * | 4/2017 | Takemoto | H01R 12/716 |
| 9,640,893 | B2 * | 5/2017 | Miyazaki | H01R 13/42 |
| 9,705,223 | B2 * | 7/2017 | Miyazaki | H01R 13/6275 |
| 2003/0190827 | A1 | 10/2003 | Korsunsky et al. | |
| 2007/0049063 | A1 | 3/2007 | Endo | |
| 2007/0202729 | A1 | 8/2007 | Uesaka | |
| 2008/0214035 | A1 | 9/2008 | Uesaka | |
| 2010/0029134 | A1 | 2/2010 | Matsuzaki et al. | |
| 2013/0012039 | A1 | 1/2013 | Nose et al. | |
| 2013/0203272 | A1 | 8/2013 | Miyazaki | |
| 2013/0323971 | A1 | 12/2013 | Kimura | |
| 2013/0337695 | A1 | 12/2013 | Malehorn, II et al. | |
| 2013/0344710 | A1 | 12/2013 | Sasaki et al. | |
| 2014/0004745 | A1 | 1/2014 | Komoto et al. | |
| 2014/0227910 | A1 | 8/2014 | Tanaka et al. | |
| 2014/0227911 | A1 | 8/2014 | Lim et al. | |
| 2014/0364003 | A1 | 12/2014 | Yunoki | |
| 2015/0263464 | A1 | 9/2015 | Arichika et al. | |
| 2015/0303597 | A1 | 10/2015 | He | |
| 2015/0380845 | A1 | 12/2015 | Goto et al. | |
| 2016/0013573 | A1 | 1/2016 | Miyazaki et al. | |
| 2016/0226173 | A1 | 8/2016 | Miyazaki | |
| 2016/0268732 | A1 | 9/2016 | Arichika et al. | |
| 2017/0365944 | A1 | 12/2017 | Yoshioka et al. | |

FOREIGN PATENT DOCUMENTS

| | | |
|---|---|---|
| EP | 1965466 | 9/2008 |
| EP | 2665132 | 11/2013 |
| JP | 2007-066887 | 3/2007 |
| JP | 2007-149447 A | 6/2007 |
| JP | 2007-149477 A | 6/2007 |
| JP | 2006-108559 | 5/2008 |
| JP | 2011-124010 | 6/2011 |
| JP | 2013-65542 | 4/2013 |
| JP | 2014-222672 | 11/2014 |
| JP | 2014-239002 | 12/2014 |
| JP | 2015-106529 | 6/2015 |
| JP | 2015-115200 | 6/2015 |
| JP | 5809198 | 9/2015 |
| TW | M257025 U | 2/2005 |
| WO | 2015/063817 | 5/2015 |

OTHER PUBLICATIONS

Written Opinion issued in PCT/JP2017/015526; dated Jul. 25, 2017, along with an English translation thereof.
Office Action issued in China Counterpart Patent Appl. No. 201780025747.4, dated Aug. 28, 2019, along with an English translation thereof.
International Search Report issued in International Bureau of WIPO Patent Application No. PCT/JP2017/015526, dated Jul. 25, 2017 , along with an english translation thereof.
International Search Report issued in International Bureau of WIPO Patent Application No. PCT/JP2017/015527, dated Jul. 18, 2017, along with an english translation thereof.
Official Communication issued in European Patent Office (EPO) Patent Application No. 17789339.3, dated Mar. 26, 2019.
Official Communication issued in European Patent Office (EPO) Patent Application No. 17789338.5, dated Mar. 26, 2019.
Office Action issued in Counterpart U.S. Appl. No. 16/096,388, dated Apr. 4, 2019.
European Official Action recited in European patent application No. 17789339.3, dated Dec. 14, 2020.

* cited by examiner

CONNECTOR AND CONNECTION SYSTEM

TECHNICAL FIELD

The invention relates generally to connectors and connection systems and, more particularly, to a connector configured to connect electronic components to each other, and a connection system.

BACKGROUND ART

For example, Patent Literature 1 discloses a known related connector configured to connect electronic components to each other. A socket forming the connector described in Patent Literature 1 includes socket terminals made of metal (contacts), a socket-side retainer metal fitting made of metal (a mounting metal fitting), and a socket housing made from resin (a housing). The socket-side retainer metal fitting is attached to the socket housing to increase strength thereof. Each of the socket terminals and the socket-side retainer metal fitting is fixed to a conductive pattern of a printed wiring board (a substrate) with solder.

In related connectors as described above, it is desired to, when the mounting metal fitting is joined to the substrate by soldering, reduce the flow of flux contained in the solder to the contacts.

CITATION LIST

Patent Literature

Patent Literature 1: WO 2015/063817 A1

SUMMARY OF INVENTION

With the foregoing in view, it is an object of the present invention to provide a connector capable of reducing the flow of flux contained in solder to contacts when a mounting metal fitting is joined to a substrate by soldering, and a connection system.

A connector according to an aspect of the present invention includes contacts, a housing and a mounting metal fitting. The housing retains the contacts. The mounting metal fitting is attached to the housing. The mounting metal fitting includes a joined section to be joined to a substrate. The joined section is exposed from a back surface of the housing to face the substrate. Each of the contacts includes an exposed section exposed from the back surface of the housing. The housing includes a protrusion and a recess. The protrusion is provided between the joined section and at least part of the exposed sections of the contacts. The protrusion protrudes from the back surface. The recess is provided between the protrusion and at least part of the exposed sections of the contacts. The recess is set lower than an end face of the protrusion to face the substrate.

A connection system according to an aspect of the present invention includes the connector and a mating connector. The mating connector includes mating contacts electrically connected with the contacts.

DESCRIPTION OF EMBODIMENTS

(1) Schema

Figure 1A:
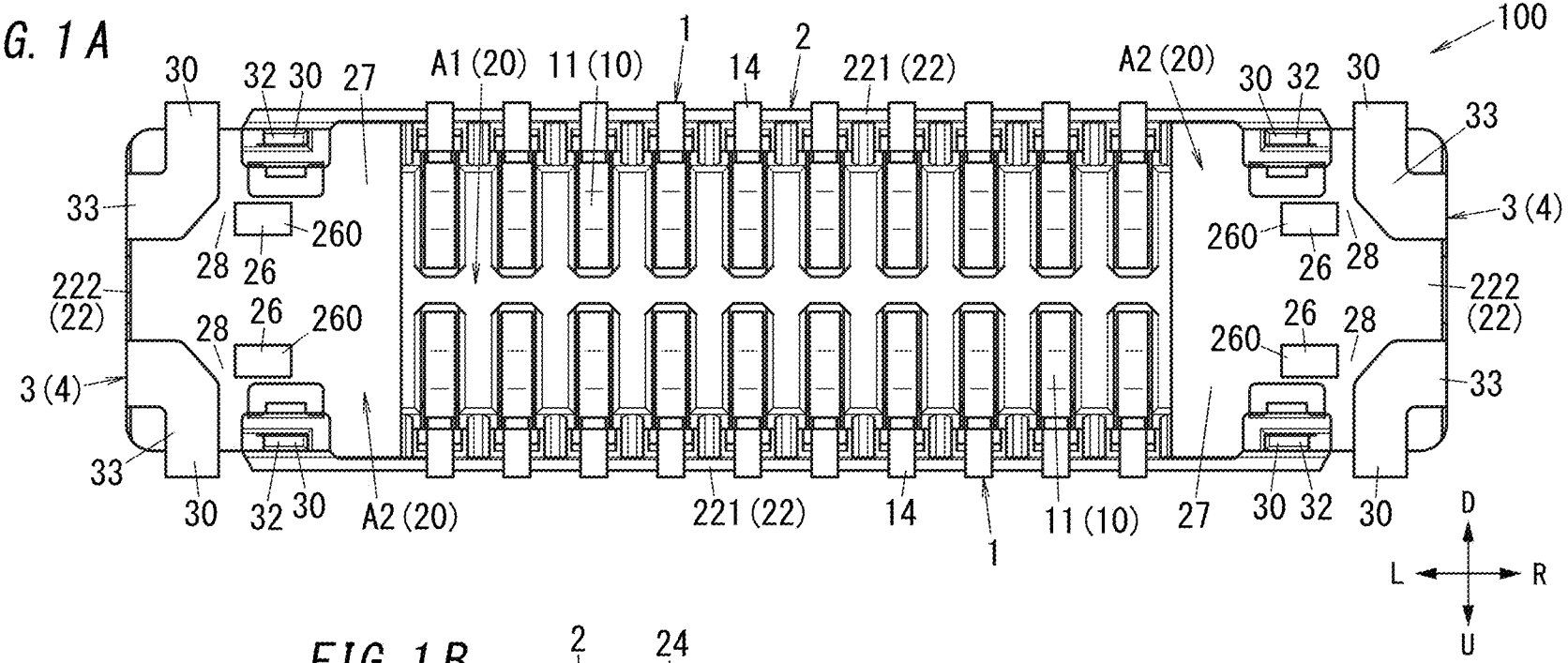
FIG. 1A is a back view of a connector according to Embodiment 1 of the present invention.

A connector 100 according to Embodiment 1 will be explained below with reference to FIGS. 1A to 5. The connector 100 according to the present embodiment is attached to a substrate such as a printed wiring board or a flexible printed wiring board. For example, the connector 100 is employed to electrically connect substrates installed in a portable terminal such as a smartphone. The usage of the connector 100 is however not limited thereto. The connector 100 may be applied to an electronic device, other than the portable terminal, such as, e.g., a camera module. In addition, the connector 100 is not limited to the application to the electrical connection between the substrates, but may be applied to the electrical connection between parts, such as between a substrate and a display or between a substrate and a battery.

As shown in FIGS. 1A to 5, the connector 100 includes contacts 1, a housing 2 and a mounting metal fitting 3. The housing 2 retains the contacts 1. The mounting metal fitting 3 is attached to the housing 2. A dimension of the housing 2 in a thickness direction thereof is, for example several mm or less. A dimension of the housing 2 in a lengthwise direction thereof is also, for example ten and several mm. In addition, a dimension of the housing 2 in a widthwise direction thereof is, for example several mm. Furthermore, the contacts 1 are aligned at intervals (at a pitch) of, for example several tenths of a mm. In the present embodiment, the contacts 1 are aligned at regular intervals, but may be aligned at irregular intervals.

The mounting metal fitting 3 possesses a joined section 30. The joined section 30 is joined to a substrate 5 with the joined section 30 exposed from a back surface 20 of the housing 2, facing the substrate 5 (see FIGS. 5 and 6). Each of the contacts 1 possesses an exposed section 10 exposed from the back surface 20 of the housing 2. Each of the contacts 1 also possesses a terminal piece 14 to be described later. The terminal piece 14 is to be joined to the substrate 5. Therefore, the joined section 30 of the mounting metal fitting 3 and each of the terminal pieces 14 of the contacts 1 are joined to the substrate 5 by soldering, so that the connector 100 is mounted on the substrate 5.

Figure 1B:
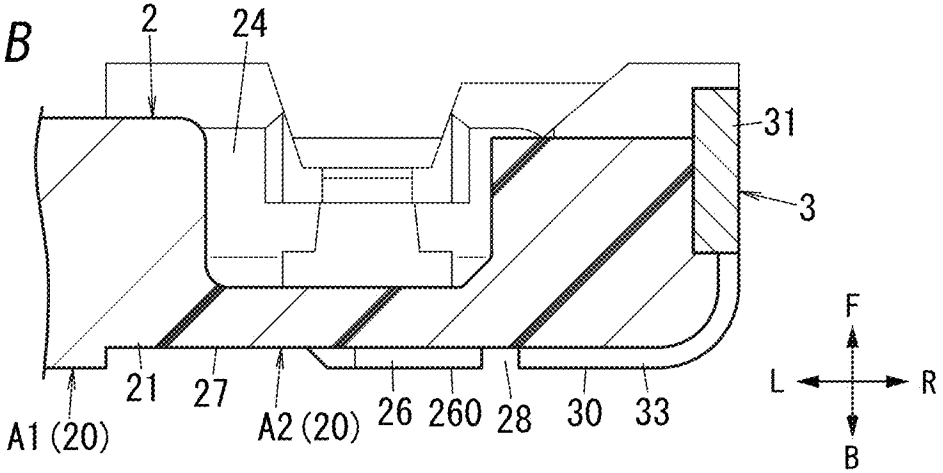
FIG. 1B is a sectional view of part of the connector according to Embodiment 1 of the present invention.
Figure 2:
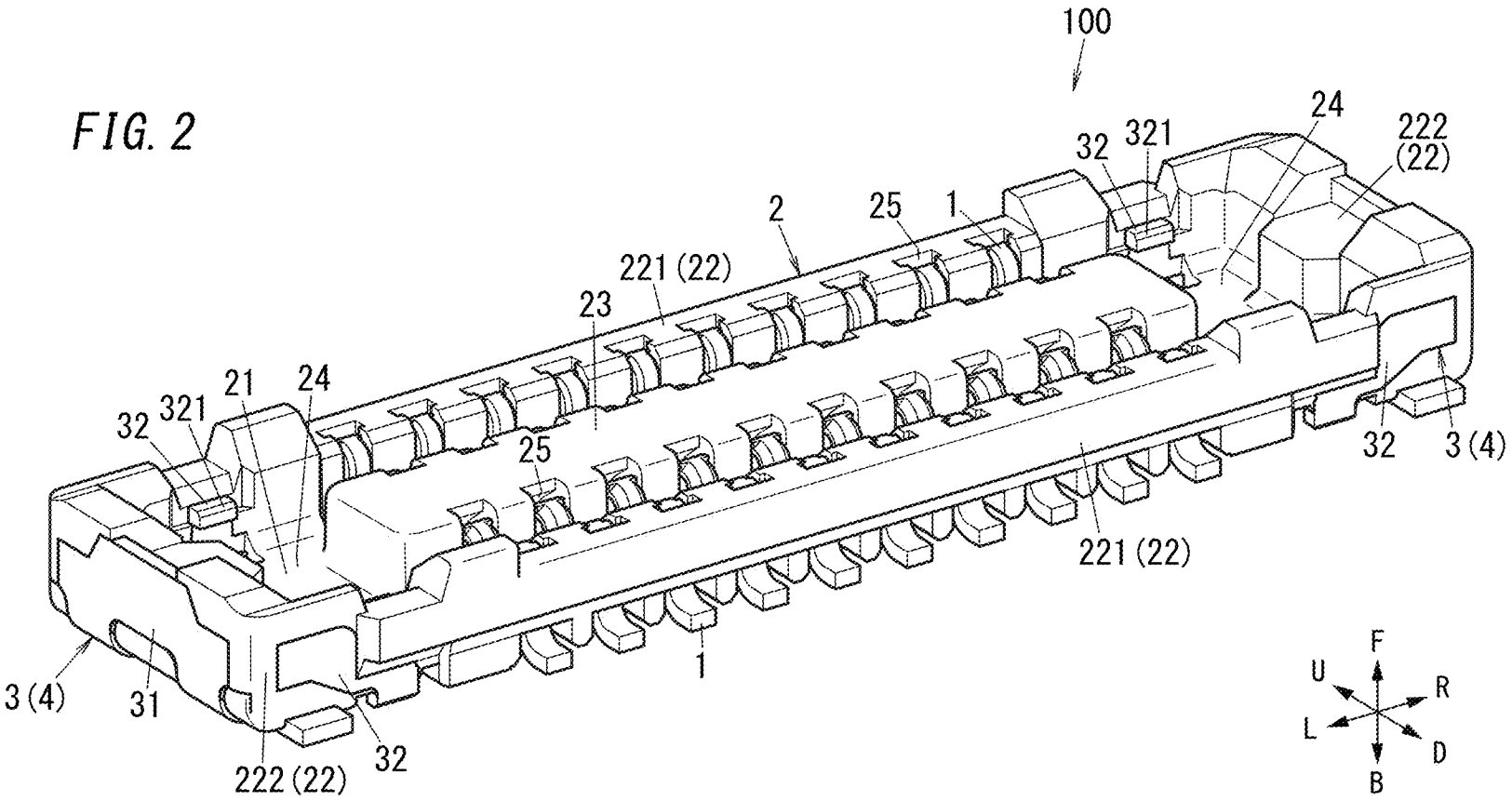
FIG. 2 is a perspective view of the connector.
Figure 3:
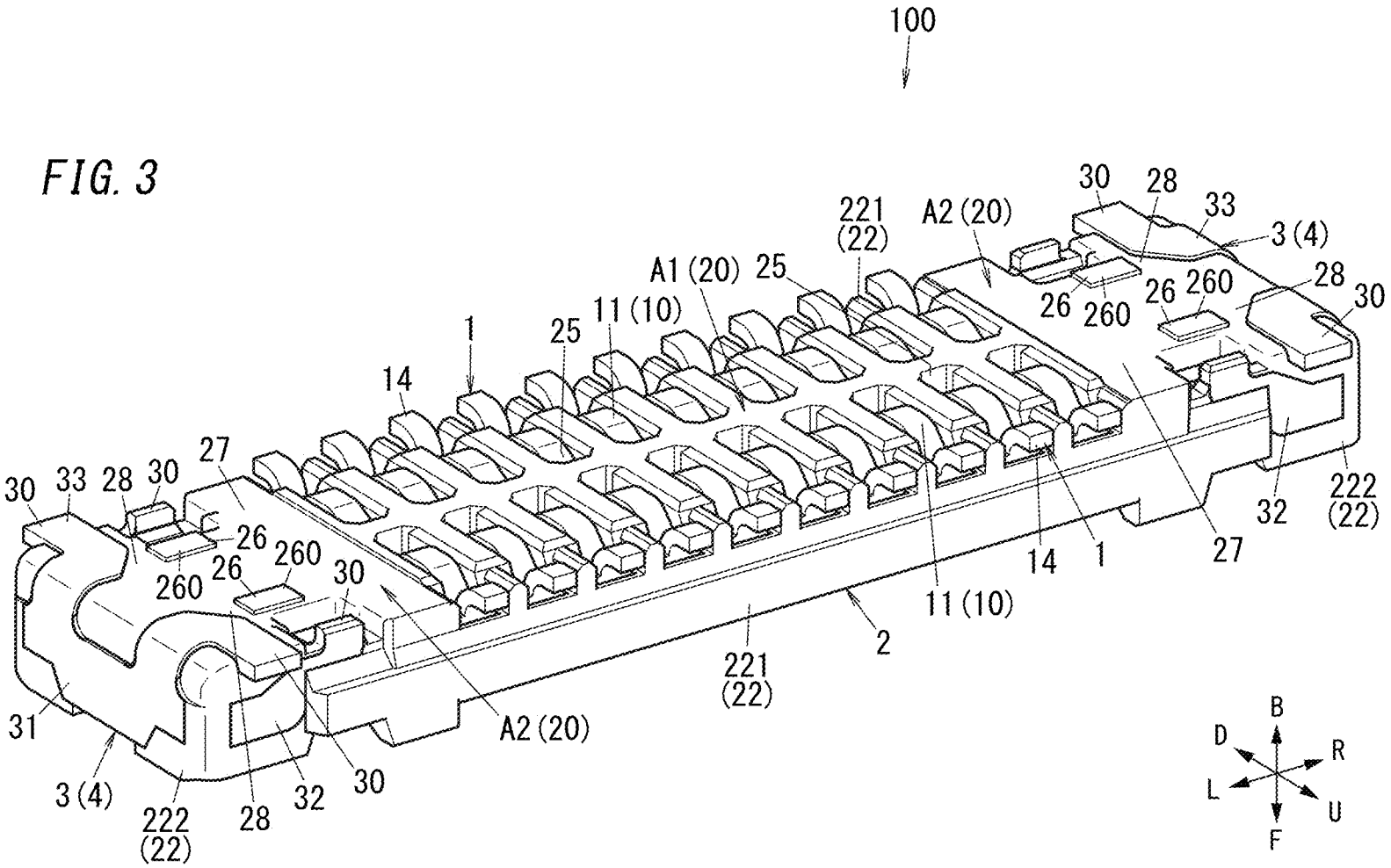
FIG. 3 is a perspective view of the connector with its front and back reversed.
Figure 4:
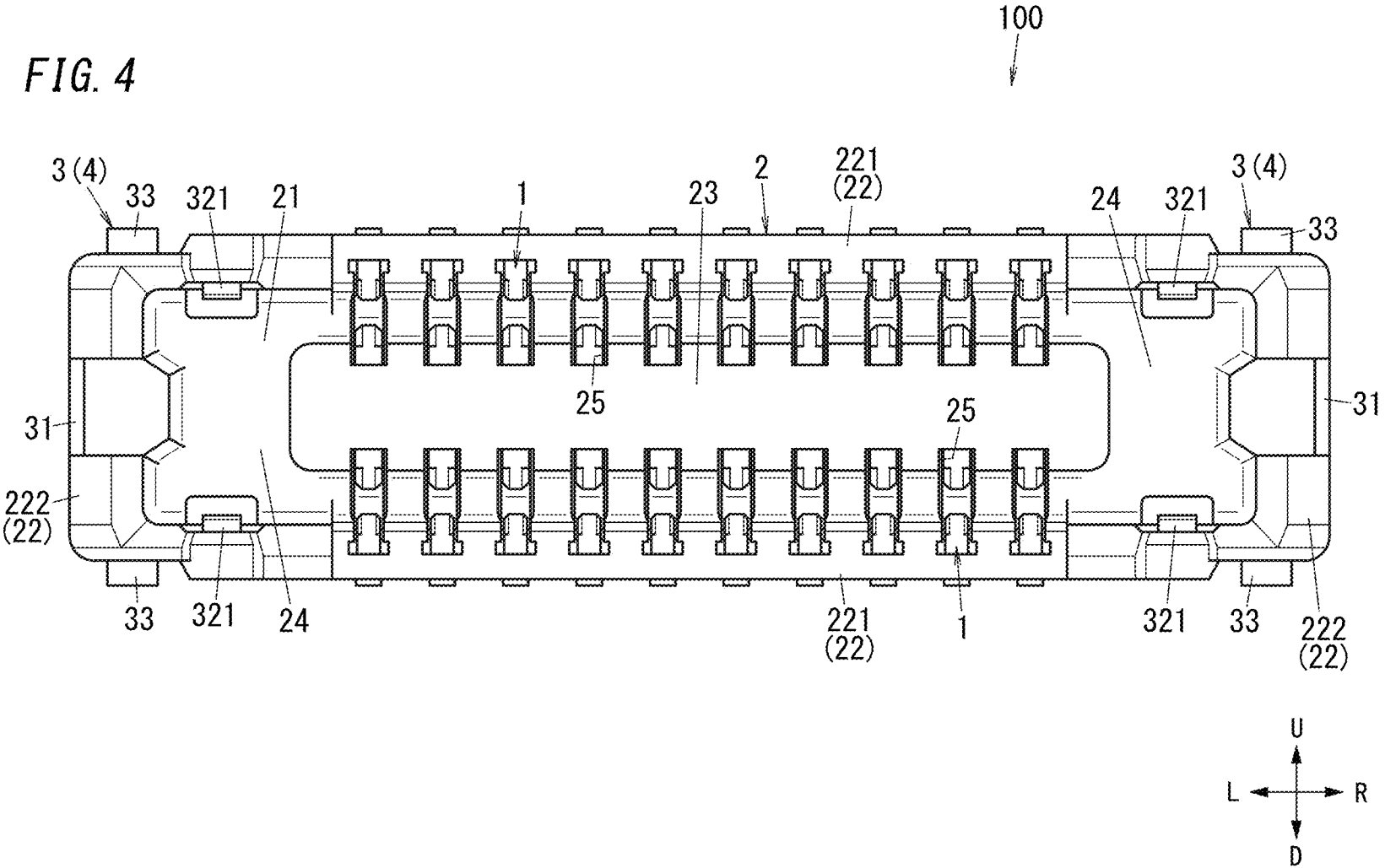
FIG. 4 is a front view of the connector.

As shown in FIGS. 1A and 1B, the housing 2 possesses a protrusion 26 and a recess 27. The protrusion 26 is provided between the joined section 30 and at least part of the exposed sections 10 of the contacts 1, and protrudes from the back surface 20. The recess 27 is provided between the protrusion 26 and at least part of the exposed sections 10 of the contacts 1, and is set lower than an end face 260 of the protrusion 26 facing the substrate 5.

In the connector 100 according to the present embodiment, when the mounting metal fitting 3 is joined to the substrate 5 by soldering, a flux 61 (see FIG. 12A) contained in solder 6 (see FIG. 12A) is melt. At this moment, the flux tends to spread. With the connector 100 according to the present embodiment, even if the flux 61 contained in the solder 6 flows to the side of the contacts 1, a place or part between the substrate 5 and the recess 27 makes it hard that the flux 61 spreads. Thus, the connector 100 according to the present embodiment enables a reduction in the flow of the flux 61 contained in the solder 6 to the contacts 1 when the mounting metal fitting 3 is joined to the substrate 5 by soldering.

(2) Details

A configuration of the connector 100 according to the present embodiment will be explained below in detail. In the explanation below, a first direction (a fore-and-aft direction) is regarded as the thickness direction of the housing 2, a second direction (a vertical direction) is regarded as the widthwise direction of the housing 2, and a third direction (a lateral direction) is regarded as the lengthwise direction of the housing 2. Note that in FIGS. 1A to 18, such directions (upward (U), downward (D), left (L), right (R), frontward (F) and backward (B)) are represented by arrows, but the arrows are depicted for the assistance of the explanation and have no entity. The directions described above are not intended to limit the usage of the connector 100 according to the present embodiment.

The connector 100 according to the present embodiment is a socket (a female connector), and includes two or more (here, twenty) contacts 1, the housing 2 and a pair of mounting metal fittings 3 as shown in FIGS. 1A to 6.

Figure 5:
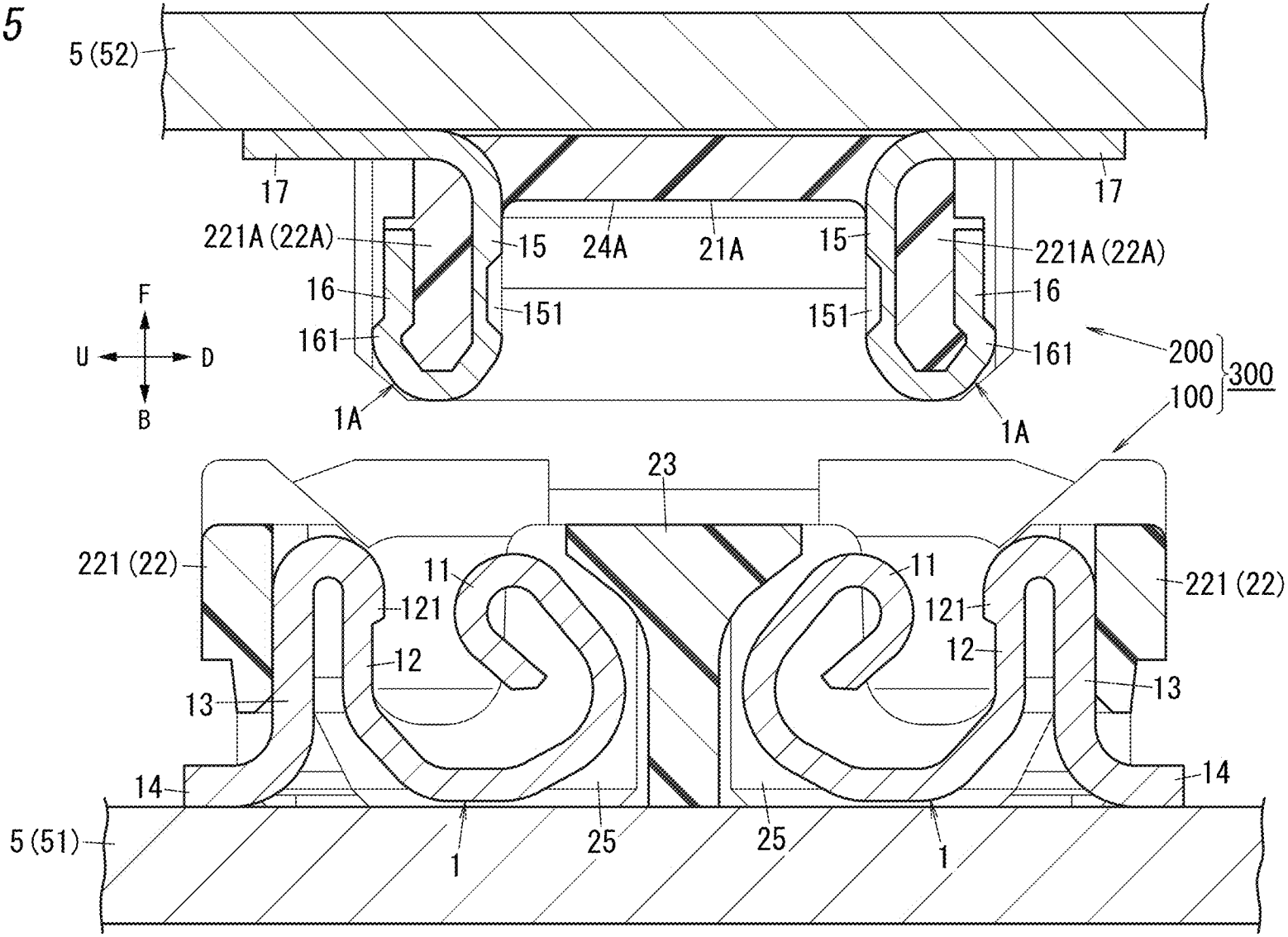
FIG. 5 is a sectional view of a connection system according to Embodiment 1 of the present invention before the connector is connected with a mating connector.
Figure 6:
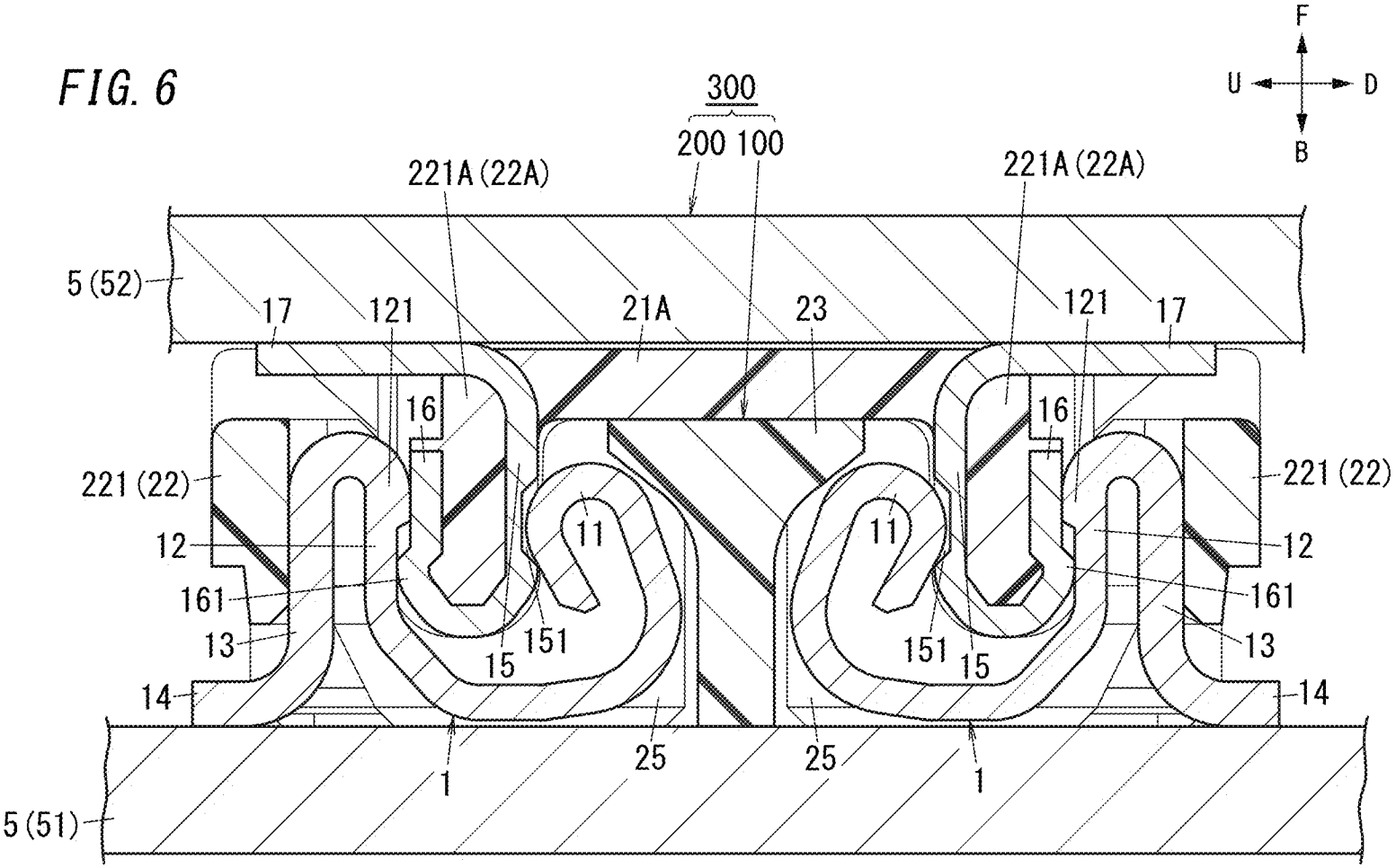
FIG. 6 is a sectional view of the connection system with the connector connected with the mating connector.
Figure 7:
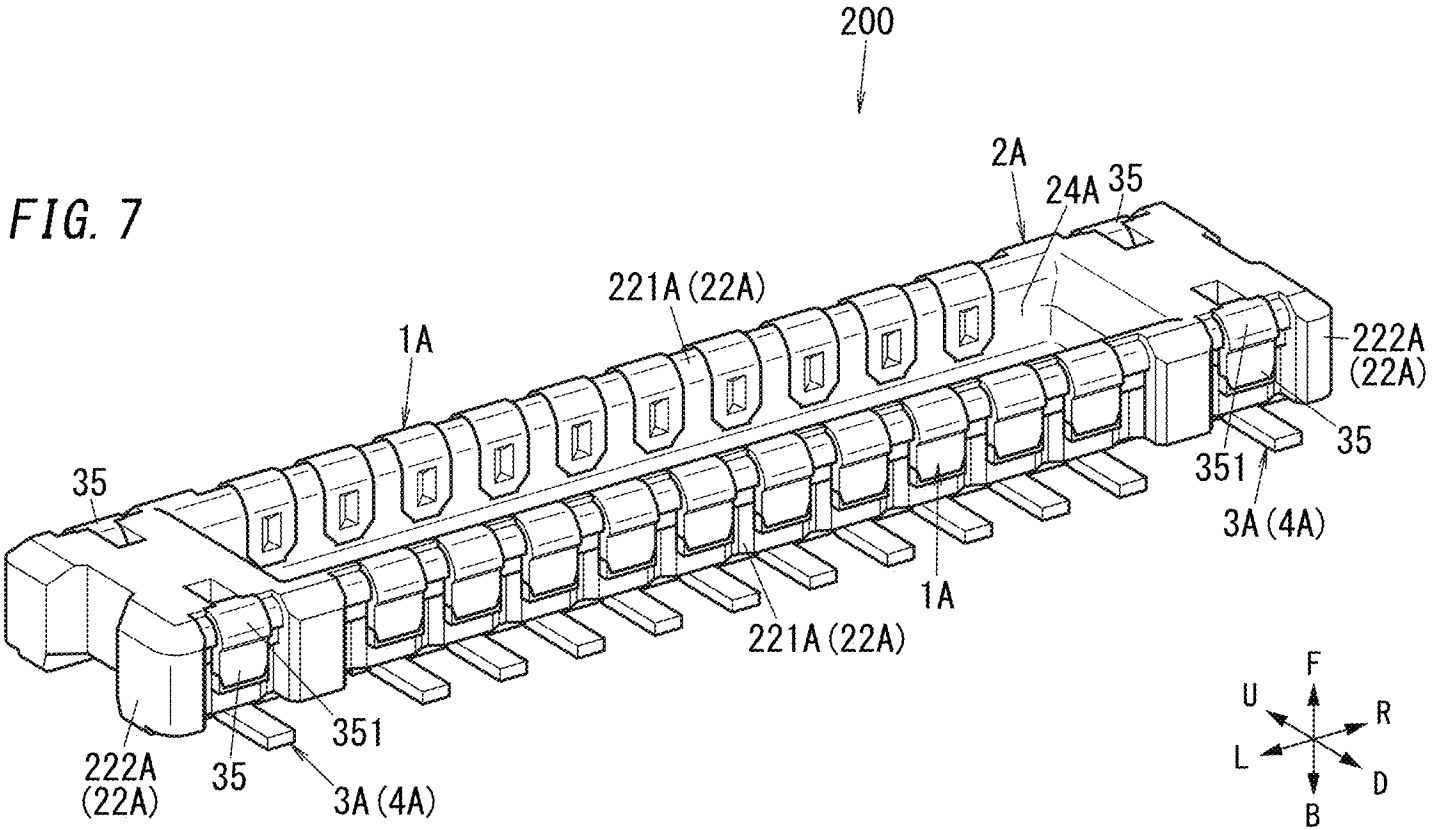
FIG. 7 is a perspective view of the mating connector in the connection system.

Each of the contacts 1 serves as a terminal for signal transmission and is formed by bending a strip metal plate. The contacts 1 are also gold-plated. As shown in FIGS. 5 and 6, each of the contacts 1 possesses a spring piece 11, a rising piece 12, a falling piece 13 and the terminal piece 14 that are formed integrally.

A tip of the spring piece 11 is curved in the shape of a horseshoe, and is flexible in the widthwise direction of the housing 2 (the vertical direction). The spring piece 11 is also configured to, in a state where contacts 1A (to be described later) of a mating connector 200 (to be described later) are inserted into a fitting section 24 (to be described later), be pushed by a corresponding contact 1A, thereby exerting elastic force toward the corresponding contact 1A.

The rising piece 12 has a plate shape elongated in the thickness direction of the housing 2 (the fore-and-aft direction). A first end (back end) of the rising piece 12 is formed integrally with the spring piece 11. The rising piece 12 is configured to, in a state where the contacts 1A of the mating connector 200 are inserted into the fitting section 24, be in contact with the corresponding contact 1A.

The rising piece 12 is also formed integrally with a protrusion 121 protruding toward the spring piece 11. In the state where the contacts 1A of the mating connector 200 are inserted into the fitting section 24, the protrusion 121 is arranged in the fore-and-aft direction along with a protrusion 161 to be described later of the corresponding contact 1A, and set further forward than the protrusion 161 of the corresponding contact 1A. Accordingly, as long as the mating connector 200 is not pulled out from the fitting section 24 with a force equal to or greater than a predetermined force, a connection state between the connector 100 and the mating connector 200 is not released with the protrusions 161 of the contacts 1A engaging with the protrusions 121 of the contacts 1. That is, the protrusions 121 of the contacts 1 and the protrusions 161 of the contacts 1A constitute a lock mechanism that allows the connection state between the connector 100 and the mating connector 200 to be released by the force equal to or greater than the predetermined force.

The falling piece 13 has a plate shape elongated in the thickness direction of the housing 2 (the fore-and-aft direction). A first end (front end) of the falling piece 13 is curved in the shape of an inverted U, and formed integrally with a second end (front end) of the rising piece 12.

The terminal piece 14 has a plate shape elongated in the widthwise direction of the housing 2 (the vertical direction). The terminal piece 14 is formed integrally with a second end (back end) of the falling piece 13. A tip of the terminal piece 14 is exposed from the housing 2 on one end side of the housing 2 in the thickness direction thereof (a back side). The terminal piece 14 has a surface (back surface) that serves as, for example a joined surface to be soldered onto the substrate 5.

As shown in FIGS. 1A to 5, the housing 2 is made from resin material that is electrically nonconductive and has a rectangular cuboid shape that is flat and elongated in the lateral direction. In the present embodiment, the housing 2 is insert molded along with the pair of mounting metal fittings 3 as inserted components. The housing 2 possesses a bottom wall 21, a periphery wall 22, a base 23, the fitting section 24, storage sections 25, protrusions 26 and recesses 27. The protrusions 26 and the recesses 27 will be explained in details in "(3) Protrusion and Recess". The bottom wall 21 has a plate shape elongated in the lateral direction, and forms a bottom of the housing 2. A back surface of the bottom wall 21 forms the back surface 20 of the housing 2.

The periphery wall 22 protrudes forward from a periphery of the bottom wall 21, and has a rectangular frame shape in plan view. That is, the periphery wall 22 is formed to surround the periphery of the bottom wall 21. Specifically, the periphery wall 22 is composed of a pair of first side walls 221 and a pair of second side walls 222. The pair of first side walls 221 is a pair of walls of the periphery wall 22 along the lengthwise direction of the housing 2. Contacts 1 are individually housed in the storage sections 25 to be described later in each of the pair of first side walls 221, and thereby retained with the contacts 1 aligned in one direction (the lateral direction). That is, each of the pair of first side walls 221 retains contacts 1 with the contacts 1 aligned in the arrangement direction (the lateral direction). In the present embodiment, each of the pair of first side walls 221 retains ten contacts 1.

A side piece 32 to be described later of the mounting metal fitting 3 is attached to each end of the pair of first side walls 221 in the lengthwise direction (the lateral direction). A main piece 31 to be described later of the mounting metal fitting 3 is attached to each of the pair of second side walls 222. That is, two side pieces 32 and one main piece 31 on one end (left end) side of the housing 2 in the lengthwise direction thereof (the lateral direction) constitute one mounting metal fitting 3. Similarly, two side pieces 32 and one main piece 31 on another end (right end) side of the housing 2 in the lengthwise direction constitute another mounting metal fitting 3.

The base 23 has a rectangular cuboid shape that is elongated in the lateral direction, and protrudes forward from a center of the bottom wall 21. Part surrounded by the bottom wall 21, the periphery wall 22 and the base 23 forms the fitting section 24 that allows the mating connector 200 to be fit in. Specifically, a pair of first side walls 221A and a pair of second side walls 222A, to be described later, of the mating connector 200 are fit in the fitting section 24. In other words, the mating connector 200 is fit in the fitting section 24. Thus, the connector 100 is connected with the mating connector 200.

The housing 2 is formed with two or more (here, 20) storage sections 25 corresponding one-to-one to the contacts 1. Each of the storage sections 25 pierces through the bottom wall 21 along the thickness direction thereof (the fore-and-aft direction). The storage sections 25 are arranged with the storage sections 25 divided down the middle on both upper and lower sides of the base 23. The storage sections 25 on both the upper and lower sides of the base 23 are aligned at regular intervals along the lengthwise direction of the housing 2 (the lateral direction). Each of the contacts 1 is inserted into a storage section 25 from backside to be housed in the storage section 25.

Each of the contacts 1 is housed in its own storage section 25, and in this state part thereof is exposed in the fitting section 24. Specifically, each tip-side part of the spring pieces 11 of the contacts 1 is exposed in the fitting section 24 from an inside of the base 23. In addition, each part of the rising pieces 12 of the contacts 1 is exposed in the fitting section 24 from an inside of a corresponding first side wall 221. Each of the contacts 1 is housed in its own storage section 25, and in this state part thereof is exposed from the bottom wall 21. Specifically, each part, along the bottom wall 21, of the spring pieces 11 of the contacts 1 pierces through the bottom wall 21 and is exposed. That is, each of the contacts 1 is considered to possess the exposed section 10 exposed from the back surface 20 of the housing 2 (part of the spring piece 11).

Therefore, when the connector 100 is connected with the mating connector 200, each part of the contacts 1, exposed in the fitting section 24 is in contact with a corresponding contact 1A of the mating connector 200. Thus, the contacts 1 of the connector 100 are electrically connected with the contacts 1A of the mating connector 200, respectively.

Each of the pair of mounting metal fittings 3 is formed by bending a metal plate made of, for example copper alloy. The pair of mounting metal fittings 3 is provided at both ends of the housing 2 in the lengthwise direction thereof (left and right ends), respectively. Each mounting metal fitting 3 is provided at one end of the housing 2 in the lengthwise direction thereof, thereby possessing a function of reinforcing the strength of the housing 2. Each mounting metal fitting 3 is composed of one main piece 31, a pair of side pieces 32 and a pair of bottom pieces 33.

Each of the pair of side pieces 32 is formed integrally with a protrusion 321 protruding inward in the widthwise direction of the housing 2 (the vertical direction). In a state where each mounting metal fitting 3A of the mating connector 200 to be described later is inserted into the fitting section 24, the protrusion 321 is arranged in the fore-and-aft direction along with a protrusion 351 to be described later of a corresponding mounting metal fitting 3A, and set further forward than the protrusion 351 of the corresponding mounting metal fitting 3A. Accordingly, as long as the mating connector 200 is not pulled out from the fitting section 24 with a force equal to or greater than a predetermined force, a connection state between the connector 100 and the mating connector 200 is not released with the protrusions 351 of the mounting metal fittings 3A engaging with the protrusions 321 of the mounting metal fittings 3. That is, the mounting metal fittings 3 and the mounting metal fittings 3A constitute a lock mechanism that allows the connection state between the connector 100 and the mating connector 200 to be released by the force equal to or greater than the predetermined force.

In the present embodiment, in a state where the connector 100 is connected with the mating connector 200, each part of the mounting metal fittings 3 exposed in the fitting section 24 is in contact with a corresponding mounting metal fitting 3A of the mating connector 200. Thus, this configuration allows the mounting metal fittings 3 to be electrically connected with the mounting metal fittings 3A, respectively. In short, each mounting metal fitting 3 (mounting metal fitting 3A) is able to be employed as a power supply terminal 4 that allows a power supply to be electrically connected with.

In the explanation below, although a mounting metal fitting 3 of the pair of mounting metal fittings 3, to be attached to one end (a left end) of the housing 2 will be explained as an example, another mounting metal fitting 3 to be attached to another end (a right end) of the housing 2 also has a configuration similar thereto. The main piece 31 is attached to a second side wall 222 that is one (a left one) of the pair of second side walls 222. A side piece 32 that is one of the pair of side pieces 32 is formed integrally with one end (a lower end) of the main piece 31, and attached to a place which is one end, in a lengthwise direction (the lateral direction), of a first side wall 221 that is one (a lower one) of the pair of first side walls 221, and where no contacts 1 are arranged. A side piece 32 that is another of the pair of side pieces 32 is formed integrally with another end (an upper end) of the main piece 31, and attached to a place which is one end, in a lengthwise direction, of a first side wall 221 that is another (an upper one) of the pair of first side walls 221, and where no contacts 1 are arranged. The pair of bottom pieces 33 is formed integrally with a back end of the main piece 31 with the pair of bottom pieces 33 bent along the bottom wall 21 of the housing 2.

A bottom piece 33 that is one of the pair of bottom pieces 33 is retained by the housing 2 with the bottom piece 33 aligned in one direction (the lateral direction) along with contacts 1 on a lower side of the base 23. A bottom piece 33 that is another of the pair of bottom pieces 33 is also retained by the housing 2 with the bottom piece 33 aligned in one direction (the lateral direction) along with contacts 1 on an upper side of the base 23.

Each surface (back surface) of the pair of bottom pieces 33 is exposed from the bottom wall 21 of the housing 2, and is to be soldered onto the substrate 5. Each back surface of the pair of side pieces 32 is also exposed from the bottom wall 21 of the housing 2, and is to be soldered onto the substrate 5. In short, the mounting metal fitting 3 is considered to possess joined sections 30 (the back surfaces of the bottom pieces 33 and the back surfaces of the side pieces 32) that are allowed to be joined onto the substrate 5 with the joined sections 30 exposed from the back surface 20 to face the substrate 5 for the housing 2. Each protrusion dimension of the joined sections 30 from the back surface 20 is, for example about 0.02 mm.

As shown in FIGS. 5 and 6, the connector 100 configured as described above is mounted on the substrate 5 (here, a first substrate 51) built in an electronic apparatus such as a smartphone. In addition, the mating connector 200 corresponding to the connector 100 is mounted on another substrate 5 (here, a second substrate 52) built in the same electronic apparatus.

When the connector 100 is connected with the mating connector 200, first conductors formed on the first substrate 51 are electrically connected with second conductors formed on the second substrate 52. Specifically, the contacts 1 of the connector 100 are electrically connected with the contacts 1A of the mating connector 200, and thereby the connector 100 is connected to the mating connector 200. In the present embodiment, the connector 100 and the mating connector 200 constitute a connection system 300. In other words, the connection system 300 includes the connector 100 and the mating connector 200.

The mating connector 200 corresponding to the connector 100 according to the present embodiment will be explained below with reference to FIGS. 5 to 10. Note that FIGS. 5 and 6 illustrate the mating connector 200 with its front and back reversed. Therefore, the mating connector 200 will be explained hereinafter based on directions defined in FIGS. 7 to 10.

In the present embodiment, the mating connector 200 is a header (a male connector), and includes two or more (herein, twenty) mating contacts 1A, a mating-side housing 2A, and mating-side mounting metal fittings 3A. In the explanation below, each mating contact 1A, the mating-side housing 2A and each mating-side mounting metal fitting 3A are simply referred to as a "contact 1A", a "housing 2A" and a "mounting metal fitting 2A" in principle, respectively.

Each of the contacts 1A is a terminal for signal transmission and formed by bending a strip metal plate. The contacts 1A are also gold-plated. As shown in FIGS. 5 and 6, each of the contacts 1A possesses a contact piece 15, a hanging piece 16 and a terminal piece 17 that are formed integrally. The contact piece 15 has a plate shape elongated in the thickness direction of the housing 2A (the fore-and-aft direction). The contact piece 15 is disposed on a surface of a periphery wall 22A to be described later, facing a fitting section 24A to be described later. The contact piece 15 is configured to, in a state where the contacts 1 of the connector 100 are inserted into the fitting section 24A, be in contact with a corresponding contact 1 of the connector 100.

The contact piece 15 is provided with a hollow 151 that curves in in a direction away from the fitting section 24A. The hollow 151 is configured to, in the state where the contacts 1 of the connector 100 are inserted into the fitting section 24A, allow part of the corresponding contact 1 of the connector 100 to be fit in. That is, the contacts 1 of the connector 100 and the hollows 151 of the contact pieces 15 constitute a lock mechanism that allows the connection state between the connector 100 and the mating connector 200 to be released by a force equal to or greater than a predetermined force.

The hanging piece 16 has a plate shape elongated in a thickness direction of the housing 2A (the fore-and-aft direction). The hanging piece 16 is arranged along an outer surface (an upper surface or a lower surface) of a corresponding first side wall 221A. One end (front end) of the hanging piece 16 is curved in the shape of an inverted U, and formed integrally with a first end (front end) of the contact piece 15. The hanging piece 16 is formed integrally with the protrusion 161 protruding along a thickness direction of the hanging piece 16 (the vertical direction). The protrusions 161 engage with respective protrusions 121 of the contacts 1, which thereby constitute the lock mechanism stated above.

The terminal piece 17 has a plate shape elongated in a widthwise direction of the housing 2A (the vertical direction). A first end of the terminal piece 17 is formed integrally with a second end (back end) of the contact piece 15. A second end of the terminal piece 17 is exposed from a bottom wall 21 of the housing 1A on one end side of the housing 2A in the thickness direction thereof (the back side). One surface (back surface) of the terminal piece 17 serves as, for example a joined surface to be soldered onto the substrate 5. That is, each of the contacts 1A is considered to possess an exposed section 10A (the back surface of the terminal piece 17) exposed from a back surface 20A of the housing 2A.

The housing 2A is made from resin material that is electrically nonconductive and has a rectangular cuboid shape that is flat and elongated in the lateral direction. The housing 2A possesses a bottom wall 21A, the periphery wall 22A, the fitting section 24A, protrusions 26A and recesses 27A. The protrusions 26A and the recesses 27A will be explained in detail in "(3) Protrusion and Recess". The bottom wall 21A has a plate shape elongated in the lateral direction, and forms a bottom of the housing 2A. In addition, a back surface of the bottom wall 21A forms the back surface 20A of the housing 2A.

The periphery wall 22A protrudes forward from a periphery of the bottom wall 21A, and has a rectangular frame shape in plan view. That is, the periphery wall 22A is formed to surround the periphery of the bottom wall 21A. Specifically, the periphery wall 22A is composed of the pair of first side walls 221A and the pair of second side walls 222A. The pair of first side walls 221A is a pair of walls of the periphery wall 22A along a lengthwise direction of the housing 2A. Part surrounded by the bottom wall 21A and the periphery wall 22A forms the fitting section 24A that allows the connector 100 to be fit in. Specifically, the base 23 of the connector 100 is fit in the fitting section 24A.

The housing 2A is insert molded along with the contacts 1A and the pair of mounting metal fittings 3A as inserted components. Half of the contacts 1A are integrally provided on an upper first side wall 221A. In addition, the remaining half of the contacts 1A is integrally provided on a lower first side wall 221A. In short, the housing 2A retains the contacts 1A aligned in an arrangement direction (the lateral direction).

Each of the pair of mounting metal fitting 3A is made of metal material such as, for example copper alloy. Each of the pair of mounting metal fitting 3A is provided at each end of the housing 2A in the lengthwise direction thereof (the lateral direction). Each mounting metal fitting 3A is provided at an end of the housing 2A in the lengthwise direction thereof, thereby possessing a function of reinforcing the strength of the housing 2A. Each mounting metal fitting 3A is composed of a pair of terminals 35. In the present embodiment, the mounting metal fittings 3A constitute a lock mechanism along with the mounting metal fittings 3 as stated above. In addition, each mounting metal fitting 3A is able to be employed as a power supply terminal 4A as stated above.

In the explanation below, although a mounting metal fitting 3A, to be attached to one end (left end) of the housing 2A, of the pair of mounting metal fittings 3A will be explained as an example, another mounting metal fitting 3A to be attached to another end (right end) of the housing 2A also has a configuration similar thereto. Each of the pair of terminals 35 has a contact piece 15, a hanging piece 16 and a terminal piece 17 that are formed integrally, like the contacts 1A. In FIGS. 7 to 10, the contact pieces 15 of the terminals 35 are not illustrated.

The terminal piece 17 of a terminal 35 that is one of the pair of terminals 35 is arranged in one direction (the lateral direction) along with contacts 1A on a lower side of the fitting section 24A and retained by the housing 2A. In addition, the terminal piece 17 of a terminal 35 that is another of the pair of terminals 35 is arranged in one direction (the lateral direction) along with contacts 1A on an upper side of the fitting section 24A and retained by the housing 2A.

One surface (back surface) of each terminal piece 17 of the pair of terminals 35 is exposed from the bottom wall 21A of the housing 2A and is to be soldered onto the substrate 5. That is, each mounting metal fitting 3A is considered to possess joined sections 30A (back surfaces of the terminal pieces 17 of the terminals 35) that are exposed from the back surface 20A of the housing 2A facing the substrate 5 and are to be joined onto the substrate 5.

(3) Protrusion and Recess

First, the protrusions 26 and the recesses 27 of the connector 100 will be explained in detail with reference to FIGS. 1A and 1B. The back surface 20 of the housing 2 is provided with the protrusions 26 and the recesses 27. Here, the back surface 20 of the housing 2 is divided into one first region A1 and two second regions A2. The first region A1 is a region in which the exposed sections 10 of the contacts 1 are disposed. The second regions A2 are regions in which the joined sections 30 of the pair of mounting metal fittings 3 are disposed. A region that allows an ejector pin to be pressed against is secured in each second region A2, where the ejector pin is used for pushing the housing 2 as a molding out of a mold. Note that whether or not each second region A2 is provided with the region that allows the ejector pin to be pressed against is arbitrary. A surface of the first region A1 to face the substrate 5 protrudes further back than respective surfaces of the two second regions A2 to face the substrate 5. In other words, the surface of the first region A1 to face the substrate 5 protrudes further toward the substrate 5 than the respective surfaces of the two second regions A2 to face the substrate 5. In short, the back surface 20 of the housing 2 is formed with a step at the boundary between the first region A1 and each second region A2.

Each of the two second regions A2 is provided with the pair of protrusions 26 and the recess 27. In the explanation below, although the pair of protrusions 26 and the recess 27 that are provided in the second region A2 on one end (right end) side of the housing 2 will be explained as an example, the pair of protrusions 26 and the recess 27 that are provided in the second region A2 on another end (left end) side of the housing 2 also have a configuration similar thereto. Each of the pair of protrusions 26 is formed integrally with the housing 2 and protrudes backward from one surface (back surface) of the second region A2 in the back surface 20. That is, each of the pair of protrusions 26 is made of the same material as the housing 2. The pair of protrusions 26 is also provided with a predetermined space therebetween in the widthwise direction of the housing 2 (the vertical direction).

A protrusion 26 that is one (an upper one) of the pair of protrusions 26 is disposed in the proximity of or at a side of an upper bottom piece 33 of the mounting metal fitting 3 in the second region A2. In addition, a protrusion 26 that is another (a lower one) of the pair of protrusions 26 is disposed in the proximity of or at a side of a lower bottom piece 33 of the mounting metal fitting 3 in the second region A2. That is, each of the pair of protrusions 26 is disposed between the first region A1 and a corresponding joined section 30. In other words, each of the pair of protrusions 26 is disposed between a corresponding joined section 30 and all the exposed sections 10 of the contacts 1.

In the present embodiment, the pair of protrusions 26 is provided in a location of the back surface 20 corresponding to the fitting section 24. Specifically, the pair of protrusions 26 is disposed on back surfaces of parts that are parts of the bottom wall 21 as one of components of the fitting section 24 and are on one end (right end) side of the bottom wall 21 in a lengthwise direction thereof (the lateral direction).

Each end face 260 (back surface) of the protrusions 26 to face the substrate 5 is substantially flush with a surface of the first region A1 to face the substrate 5. A region between the first region A1 and the pair of protrusions 26 on the second region A2 is set further forward than the end faces 260 and the surface of the first region A1 to face the substrate 5. In other words, a surface of part of the second region A2 to face the substrate 5 in a region between the first region A1 and the pair of protrusions 26 curves in in the direction opposite the direction of the substrate 5 to be lower than the end faces 260 and the surface of the first region A1 to face the substrate 5. That is, the back surface 20 of the housing 2 is provided with the recess 27 that is provided between the pair of protrusions 26 and all the exposed sections 10 of the contacts 1 and is lower than the end faces 260.

The end faces 260 of the protrusions 26 are substantially flush with back surfaces of the bottom pieces 33 of the mounting metal fitting 3. Part of the second region A2 between the protrusions 26 and the bottom pieces 33 is set further forward than the end faces 260 and the back surfaces of the bottom pieces 33. In other words, a surface of part of the second region A2 to face the substrate 5 in a region between the protrusions 26 and the bottom pieces 33 curves in in the direction opposite the direction of the substrate 5 to be lower than the end faces 260 and the back surfaces of the bottom pieces 33 In short, the housing 2 possesses a groove 28 that is provided between the joined sections 30 and the protrusions 26 and is lower than the end faces 260.

Figure 8:
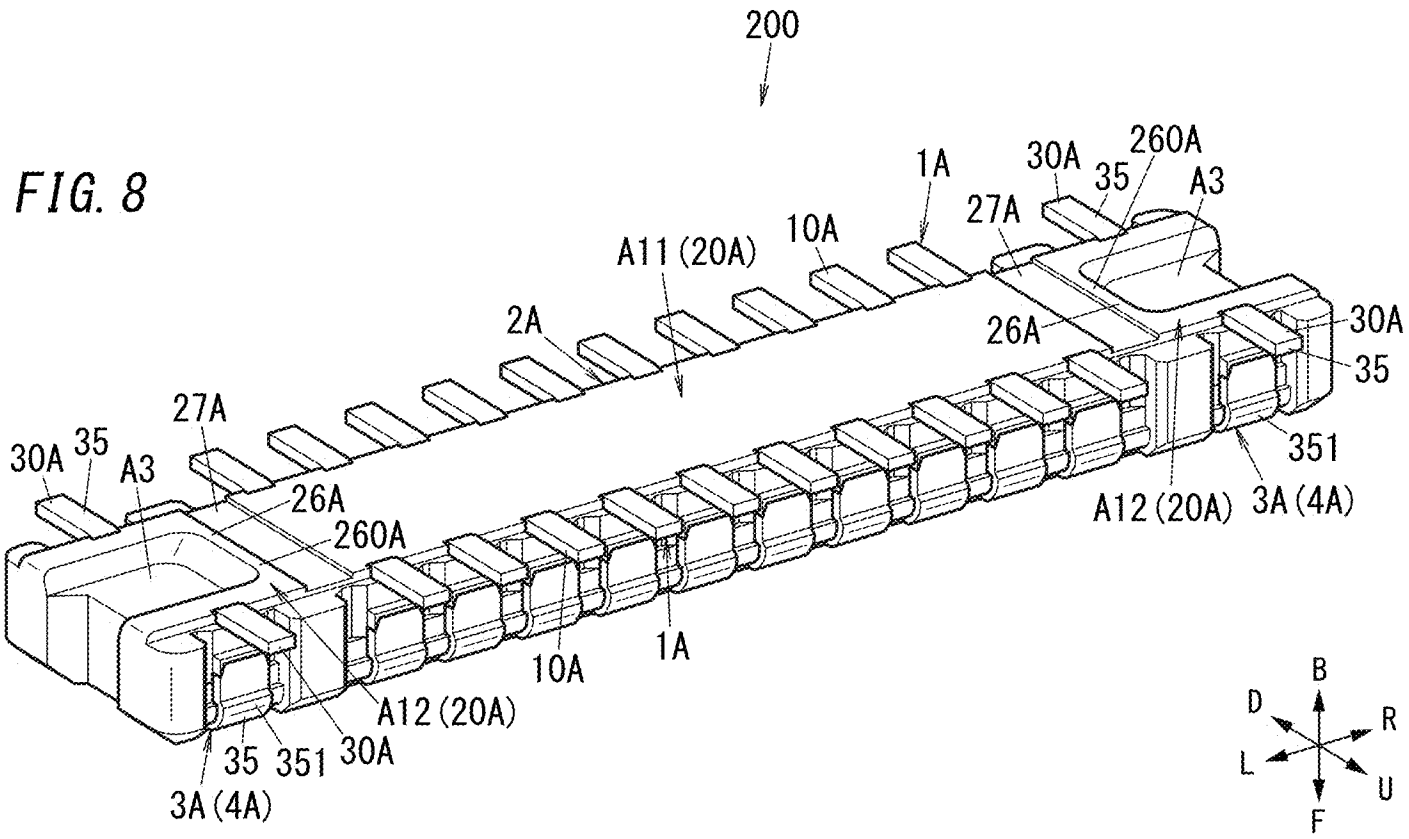
FIG. 8 is a perspective view of the mating connector in the connection system with its front and back reversed.
Figure 9:
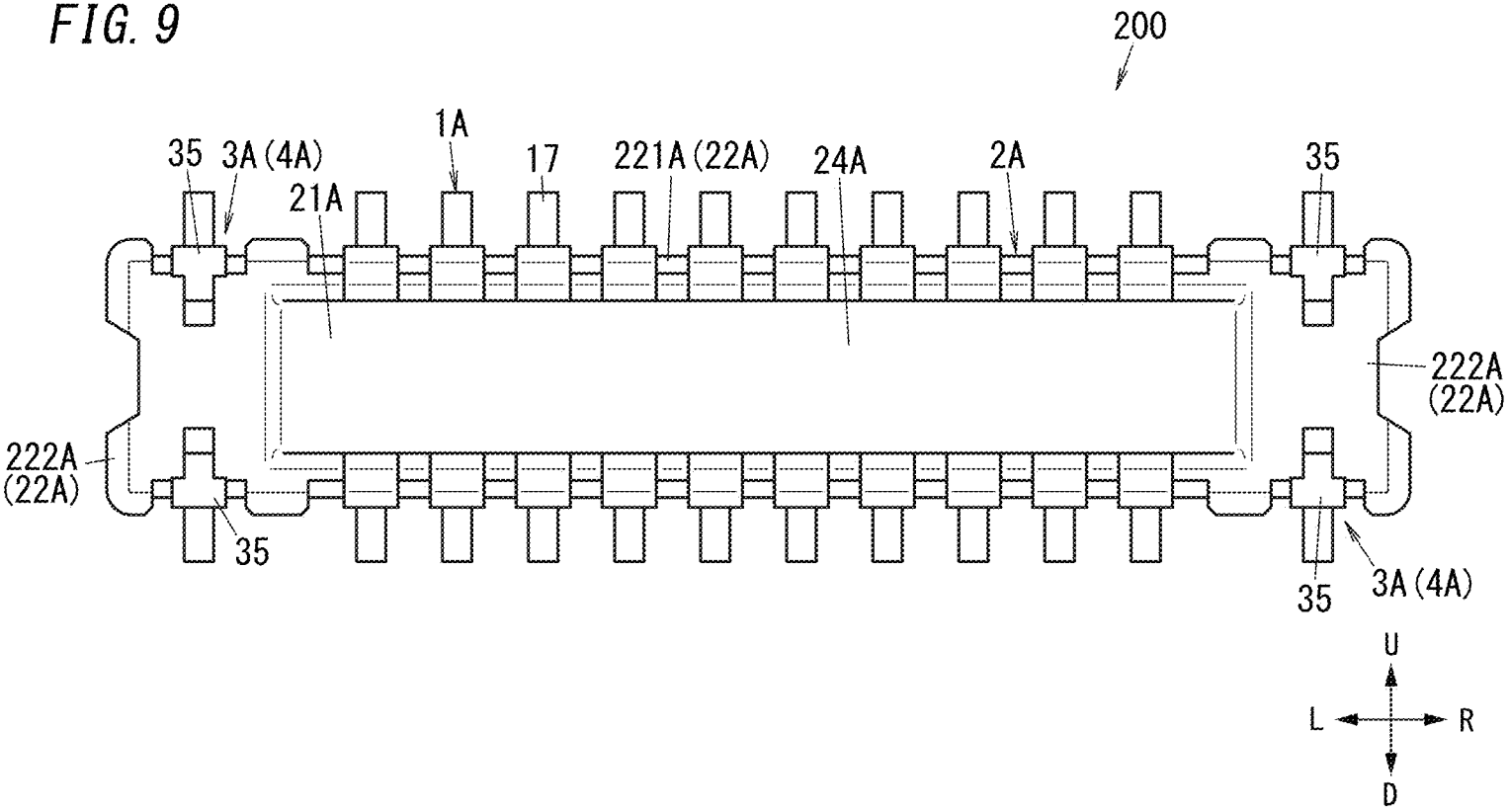
FIG. 9 is a front view of the mating connector in the connection system.
Figure 10:
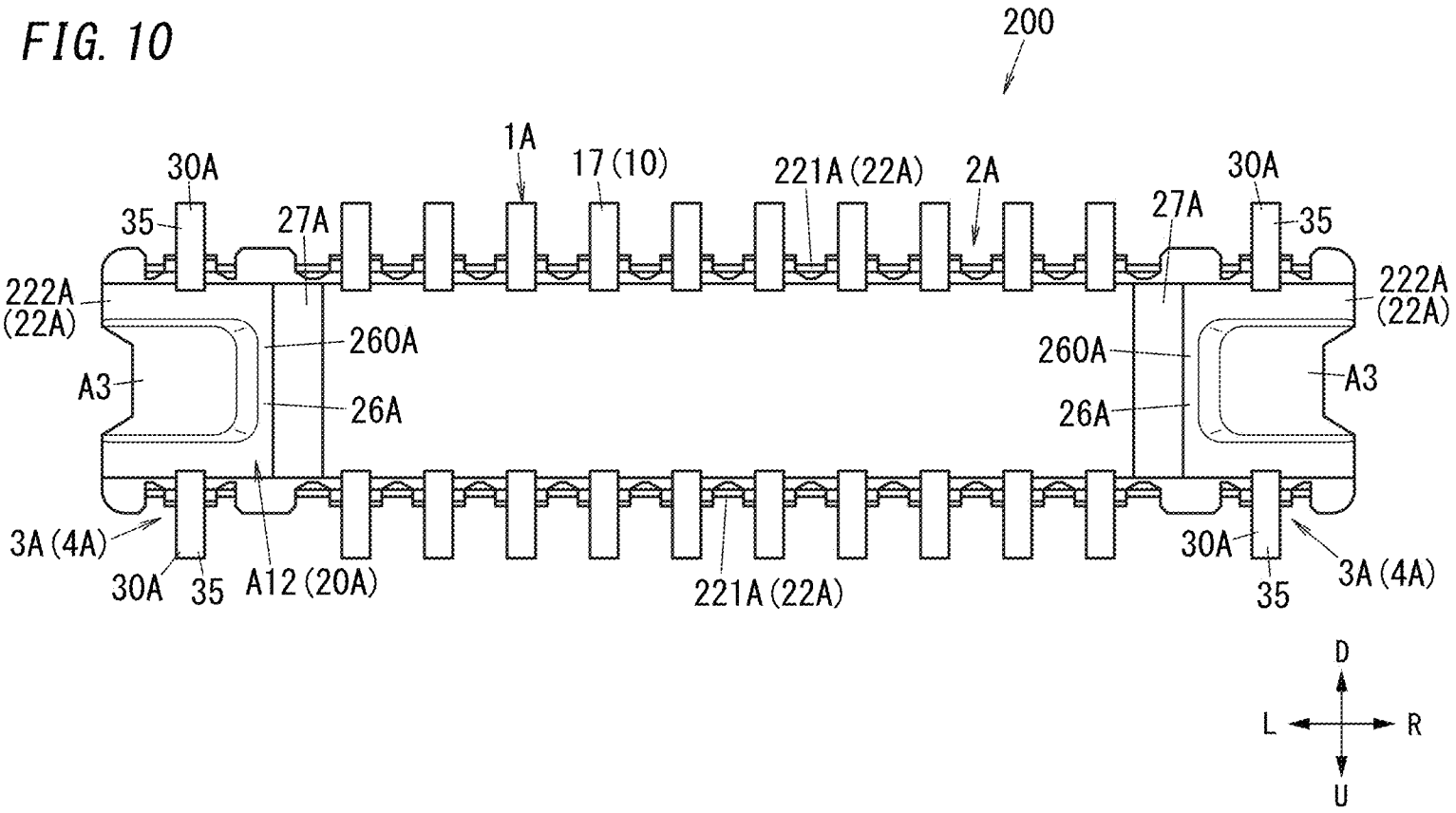
FIG. 10 is a back view of the mating connector in the connection system.

Next, the protrusions 26A and the recesses 27A of the mating connector 200 will be explained in detail with reference to FIGS. 8 and 10. The back surface 20A of the housing 2A is provided with the protrusions 26A and the recesses 27A. Here, the back surface 20A of the housing 2A is divided into one first region A11 and two second regions A12. The first region A11 is a region in which the exposed sections 10A of the contacts 1A are disposed. The second regions A12 are regions in which the joined sections 30A of the pair of mounting metal fittings 3A are disposed. Each second region A12 is provided with a region A3 that curves in forward.

Each of the two second regions Alt is provided with the protrusion 26A and the recess 27A. In the explanation below, although the protrusion 26A and the recess 27A provided in a second region A12 on one end (right end) side of the housing 2A will be explained as an example, the protrusion 26A and the recess 27A provided in a second region A12 on another end (left end) side of the housing 2A also have a configuration similar thereto.

The protrusion 26A is provided between the first region A11 and the joined sections 30A. In other words, the protrusion 26A is provided between the joined sections 30A and all the exposed sections 10A of the contacts 1A. In the present embodiment, the protrusion 26A has, but not limited to, a U-shape in a plan view as shown in FIGS. 8 and 10. The recess 27A is provided between the first region A11 and the protrusion 26A and set further forward than an end face 260A of the protrusion 26A to face the substrate 5. In other words, the surface of the recess 27A to face the substrate 5 curves in in the direction opposite the direction of the substrate 5 to be lower than the end face 260A of the protrusion 26A to face the substrate 5. A bottom surface of the recess 27A is contained in the back surface of the bottom wall 21A and also contained in the back surface 20A of the housing 2A. That is, the back surface 20A of the housing 2A is provided with the recess 27A that is provided between the protrusion 26A and all the exposed sections 10A of the contacts 1A and is lower than the end face 260A. Note that the surface of the first region A11 to face the substrate 5 is substantially flush with the end face 260A. In addition, part of the second region A12 other than the region A3 and the recess 27A protrude backward from the back surface 20A. That is, part of the second region A12 other than the region A3 and the recess 27A is a region of the protrusion 26A.

(4) Advantage

Figure 11A:
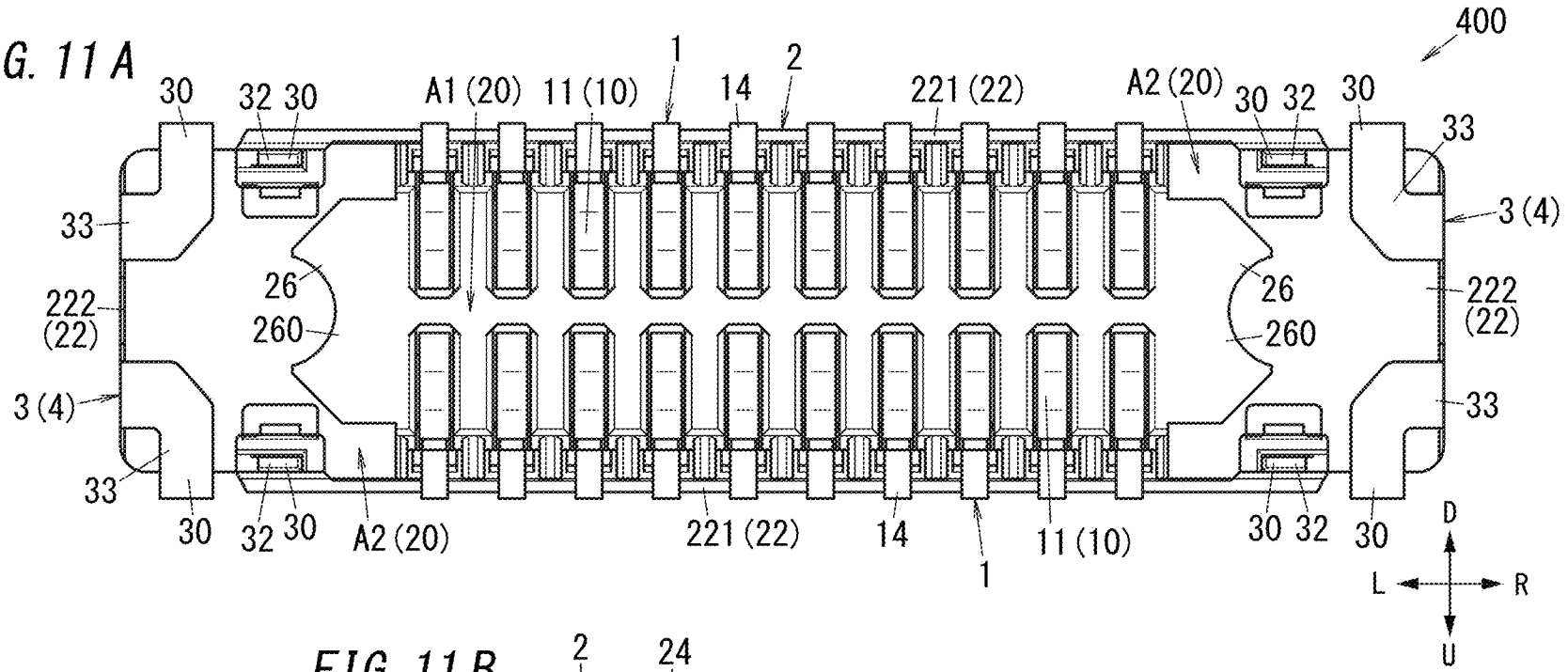
FIG. 11A is a back view of a connector as a comparative example.
Figure 11B:
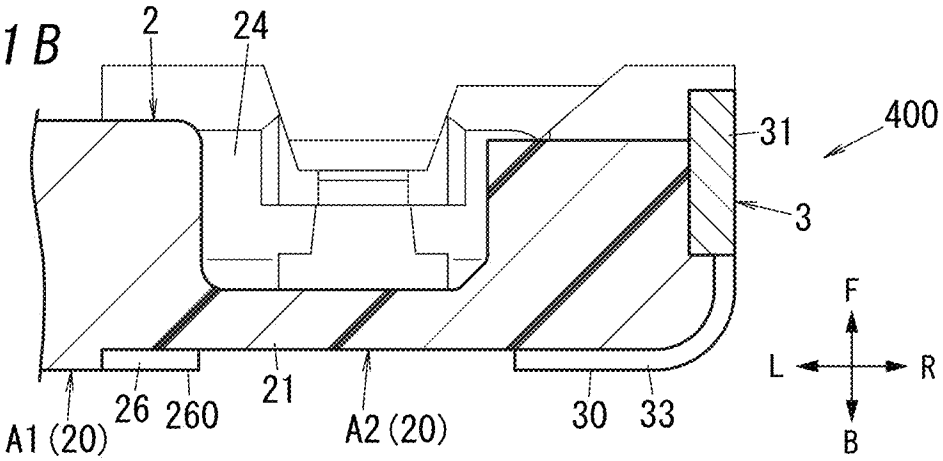
FIG. 11B is a sectional view of part of the connector as the comparative example.

An advantage of the connector 100 according to the present embodiment will be explained while comparing to a connector 400 as a comparative example. Note that the basic configuration of the connector 400 as the comparative example is similar to that of the connector 100 according to the present embodiment, and therefore the description of common points will be omitted. As shown in FIGS. 11A and 11B, in place of the pair of protrusions 26, one protrusion 26 is provided on each of two second regions A2 in the connector 400 as the comparative example. The protrusion 26 on each of the two second regions A2 is formed integrally with a first region A1. That is, no recess 27 is provided between the protrusion 26 and the first region A1 in the connector 400 as the comparative example.

Here, when the connector is mounted on a substrate by, for example reflow soldering, the solder is exposed to a high temperature environment, thereby melting flux contained in the solder. The melted flux spreads from a periphery of the joined place along the substrate to some extent. In this case, there is a possibility that the flux will further spread while penetrating into a comparatively narrow place between the substrate and the connector by a capillary phenomenon and the like.

When the connector 400 as the comparative example is mounted on a substrate 5, each joined section 30 of a pair of mounting metal fittings 3 and each terminal piece 14 of contacts 1 are soldered onto the substrate 5. With the connector 400 as the comparative example, part of each second region A2 between the substrate 5 and a corresponding protrusion 26 is narrower than that of the other part. Accordingly, the flux 61 contained in the solder 6 adhered to each joined section 30 may spread between a corresponding second region A2 and the substrate 5 to penetrate into a place between the substrate 5 and a corresponding protrusion 26 by a capillary phenomenon and the like. With the connector 400 as the comparative example, since an end face 260 of each protrusion 26 is substantially flush with a surface of the first region A1 to face the substrate 5, the flux 61 penetrating thereinto may flow into the first region A1 by a capillary phenomenon and the like. In this case, if respective flux 61 adheres to contacts 1, respective elasticity of the contacts 1 is lost and thereby the original function of the contacts 1 may be spoiled.

In contrast, the connector 100 according to the present embodiment is provided with the recesses 27 between the first region A1 and the protrusions 26. In addition, a place between the substrate 5 and each recess 27 is thicker than respective places between the substrate 5 and each pair of protrusions 26. Accordingly, even if flux 61 penetrates into a place between the substrate 5 and a protrusion 26 by a capillary phenomenon and the like, a flow channel of the flux 61 is enlarged at the place between the substrate 5 and the recess 27, thereby making it hard that the capillary phenomenon and the like occur. In other words, respective places between the substrate 5 and the recesses 27 make it hard that respective flux 61 penetrating into respective places between the substrate 5 and the protrusions 26 spreads. The connector 100 according to the present embodiment therefore enables a reduction in the flow of the respective flux 61 into the region (the first region A1) where the contacts 1 are disposed more than the connector 400 as the comparative example does.

Figure 12A:
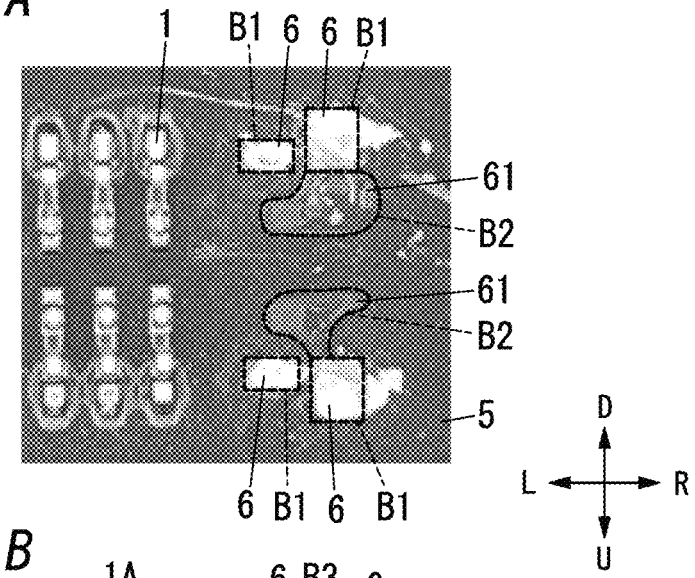
FIG. 12A is a plan view of the connector according to Embodiment 1 of the present invention in a state where the connector is mounted on a substrate by soldering.
Figure 12B:
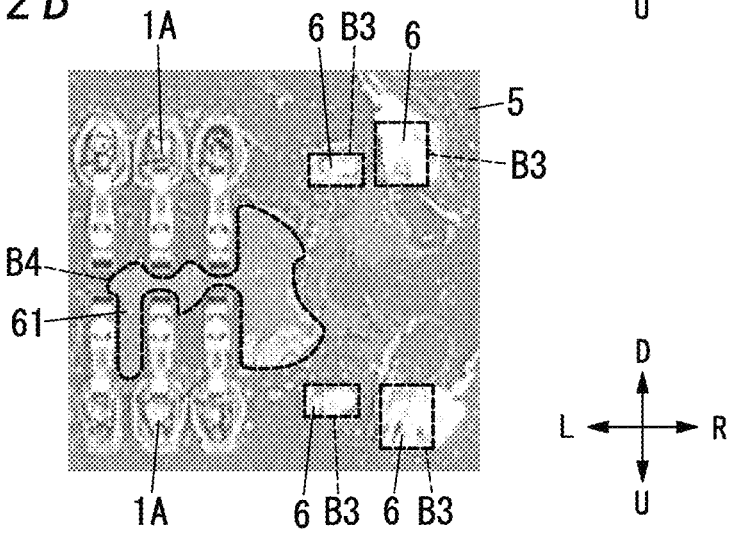
FIG. 12B is a plan view of the connector as the comparative example in a state where the connector as the comparative example is mounted on a substrate by soldering.

Here, the present inventors conducted experiments on verification of spread of flux 61 after mounting a connector on a substrate. The experiments were conducted under adverse conditions among supposed soldering conditions. Here, the "adverse conditions" include a relatively high reflow temperature, solder 6 containing flux 61 that is relatively easy to penetrate, and reflow soldering with low oxygen concentration. The experiments will be described with reference to FIGS. 12A and 12B. FIG. 12A shows part of a grayscale converted image representing a state where after mounting the connector 100 according to the present embodiment on a substrate 5, the housing 2 was peeled from the substrate 5. FIG. 12B shows part of a grayscale converted image representing a state where after mounting the connector 400 as the comparative example on a substrate 5, a housing 2 thereof was peeled from the substrate 5. In each of FIGS. 12A and 12B, contacts 1 remain with the contacts 1 soldered onto a corresponding substrate 5.

As shown in FIG. 12B, in the connector 400 as the comparative example, flux 61 contained in solder 6 (see respective regions surrounded by broken lines B3) adhered to each joined section 30 flows into a region where contacts 1 are disposed (see a region surrounded by a broken line B4). In contrast, as shown in FIG. 12A, in the connector 100 according to the present embodiment, flux 61 contained in solder 6 (see respective regions surrounded by broken lines B1) adhered to each joined section 30 of the pair of protrusions 26 remains around a corresponding protrusion 26 (see a region surrounded by each broken line B2), and does not flow into a region where contacts 1 are disposed.

As stated above, the connector 100 according to the present embodiment makes it hard that even if flux 61 contained in solder 6 flows to the side of the contacts 1 when each mounting metal fitting 3 is soldered onto the substrate 5, the flux 61 spreads in a place between the substrate 5 and a corresponding recess 27. The connector 100 according to the present embodiment therefore makes it possible to, when each mounting metal fitting 3 is joined to the substrate 5 by soldering, reduce the flow of flux 61 contained in each solder 6 to the contacts 1.

In the present embodiment, the distance between the substrate 5 and each recess 27 is preferably set to a distance which makes it hard that a capillary phenomenon and the like occur in a state where the connector 100 according to the present embodiment is mounted on the substrate 5. In this case, even if flux 61 penetrates into a place between the substrate 5 and a protrusion 26 by a capillary phenomenon and the like, the flux 61 hardly spreads in the place between the substrate 5 and the protrusion 26.

In the present embodiment, the end faces 260 of the protrusions 26 are substantially flush with the joined sections 30, but are not intended to be limited thereto. For example, each joined section 30 may protrude further back than the end faces 260 of the protrusions 26. That is, each protrusion dimension of the joined sections 30 from the back surface 20 is preferably equal to or greater than each protrusion dimension of the protrusions 26 from the back surface 20, but is not intended to be limited thereto.

In the present embodiment, the protrusions 26 are made of the same material as the housing 2, but are not intended to be limited thereto. For example, each mounting metal fitting 3 may be provided integrally with the protrusions 26. That is, the protrusions 26 may be made of the same material as the mounting metal fitting 3.

In the present embodiment, the connector 100 is the socket, but is not intended to be limited thereto. For example, the connector 100 may be a header. That is, the mating connector 200 according to the present embodiment may be a connector 100.

(5) Modified Examples

As modified examples of the connector 100 according to the present embodiment, connectors 101 to 105 as first to fifth modified examples will be explained below. Note that respective basic configurations of the connectors 101 to 105 as the first to fifth modified examples are similar to that of the connector 100 according to the present embodiment, and therefore the description of common points will be omitted. In the connection system 300, each of the connectors 101 to 105 as the first to fifth modified examples may be employed in place of the connector 100 according to the present embodiment.

(5.1) First Modified Example

Figure 13A:
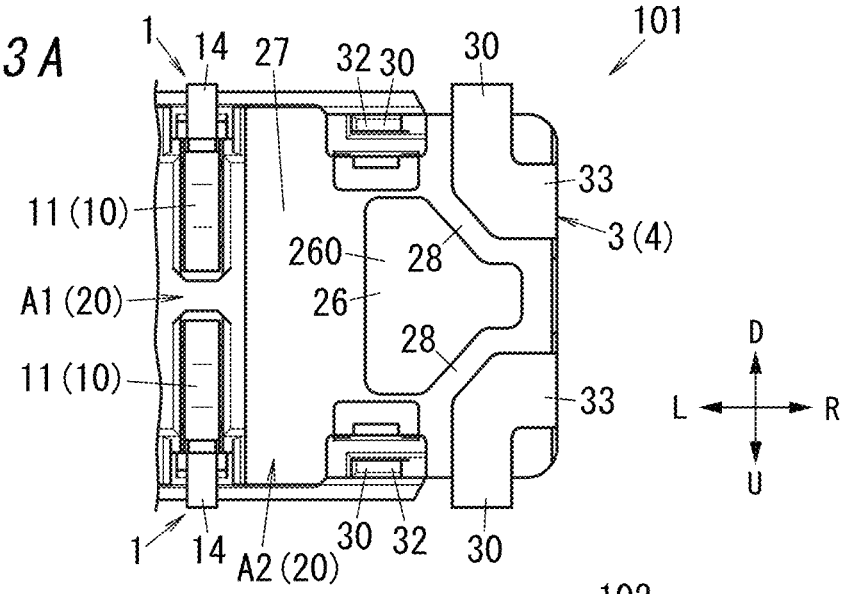
FIG. 13A is a back view of a connector as a first modified example according to Embodiment 1 of the present invention.

In place of each pair of protrusions 26, the connector 101 as the first modified example according to the present embodiment is provided with one protrusion 26 in each of two second regions A2 as shown in FIG. 13A. Note that FIG. 13A shows only one end (right end) of a housing 2 in a lengthwise direction thereof. The protrusion 26 has a triangular shape in plan view. Specifically, the protrusion 26 has, in plan view, a shape including two rectangles having different lengths in a lengthwise direction thereof (the vertical direction) and a trapezoid between the two rectangles. In addition, a recess 27 is provided between the protrusion 26 and the first region A1. A groove 28 is also provided between the protrusion 26 and each of a pair of bottom pieces 33. That is, respective grooves 28 are provided between the protrusion 26 and joined sections 30.

The present modified example makes it possible to, when each mounting metal fitting 3 is joined to a substrate 5 by soldering, reduce the flow of flux 61 contained in solder 6 to contacts 1, like the present embodiment.

(5.2) Second Modified Example

Figure 13B:
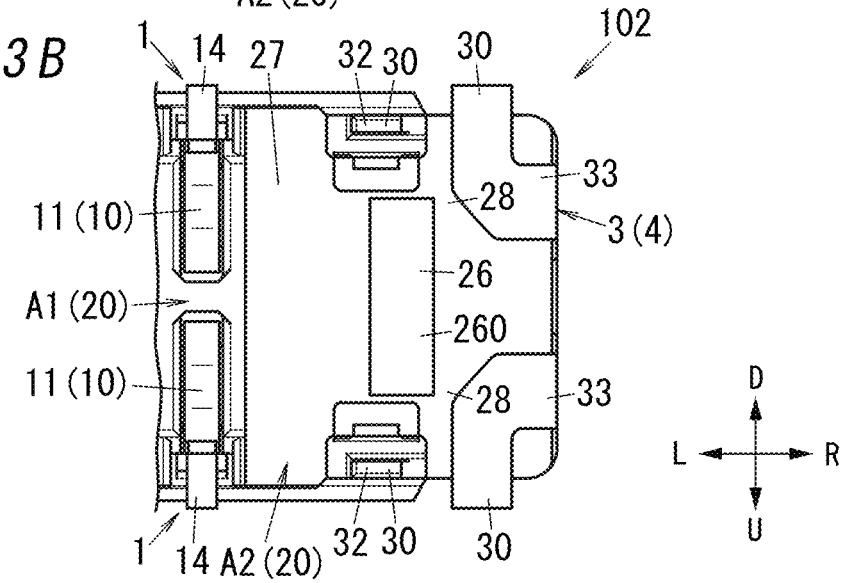
FIG. 13B is a back view of a connector as a second modified example according to Embodiment 1 of the present invention.

In place of each pair of protrusions 26, the connector 102 as the second modified example according to the present embodiment is provided with one protrusion 26 in each of two second regions A2 as shown in FIG. 13B. Note that FIG. 13B shows only one end (right end) of a housing 2 in a lengthwise direction thereof. The protrusion 26 has, in plan view, a rectangular shape elongated in a widthwise direction of a housing 2 (the vertical direction). The protrusion 26 is disposed at a region between a pair of side pieces 32. A groove 28 is also provided between the protrusion 26 and each of a pair of bottom pieces 33. That is, respective grooves 28 are provided between the protrusion 26 and joined sections 30.

The present modified example makes it possible to, when each mounting metal fitting 3 is joined to a substrate 5 by soldering, reduce the flow of flux 61 contained in solder 6 to contacts 1, like the present embodiment.

(5.3) Third Modified Example

Figure 13C:
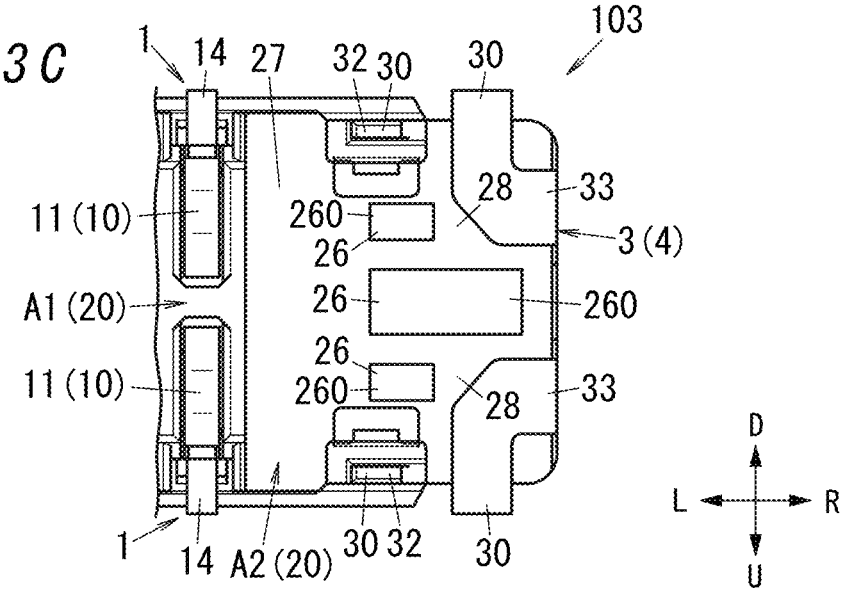
FIG. 13C is a back view of a connector as a third modified example according to Embodiment 1 of the present invention.

As shown in FIG. 13C, the connector 103 as the third modified example according to the present embodiment is provided with further one protrusion 26 in addition to a pair of protrusions 26, namely three protrusions 26 on each of two second regions A2. Note that FIG. 13C shows only one end (right end) of a housing 2 in a lengthwise direction thereof. Each of the three protrusions 26 has, in plan view, a rectangular shape elongated in a lengthwise direction of a housing 2 (the lateral direction). The three protrusions 26 are arranged at intervals in a widthwise direction of the housing 2 (the vertical direction) in a region between a pair of side pieces 32. A dimension in a lengthwise direction (the lateral direction) of a protrusion 26, at a center, of the three protrusions 26 is longer than those of two other protrusions 26.

A place between the three protrusions 26 and each of a pair of bottom pieces 33 is provided with a groove 28. In addition, a place between an upper protrusion 26 of the three protrusions 26 and one of the pair of side pieces 32 is provided with a groove 28, while a place between a lower protrusion 26 of the three protrusions 26 and another of the pair of side pieces 32 is provided with a groove 28. That is, a place between the protrusions 26 and each joined section 30 is provided with one groove 28.

The present modified example makes it possible to, when each mounting metal fitting 3 is joined to a substrate 5 by soldering, reduce the flow of flux 61 contained in solder 6 to contacts 1, like the present embodiment.

(5.4) Fourth Modified Example

Figure 14:
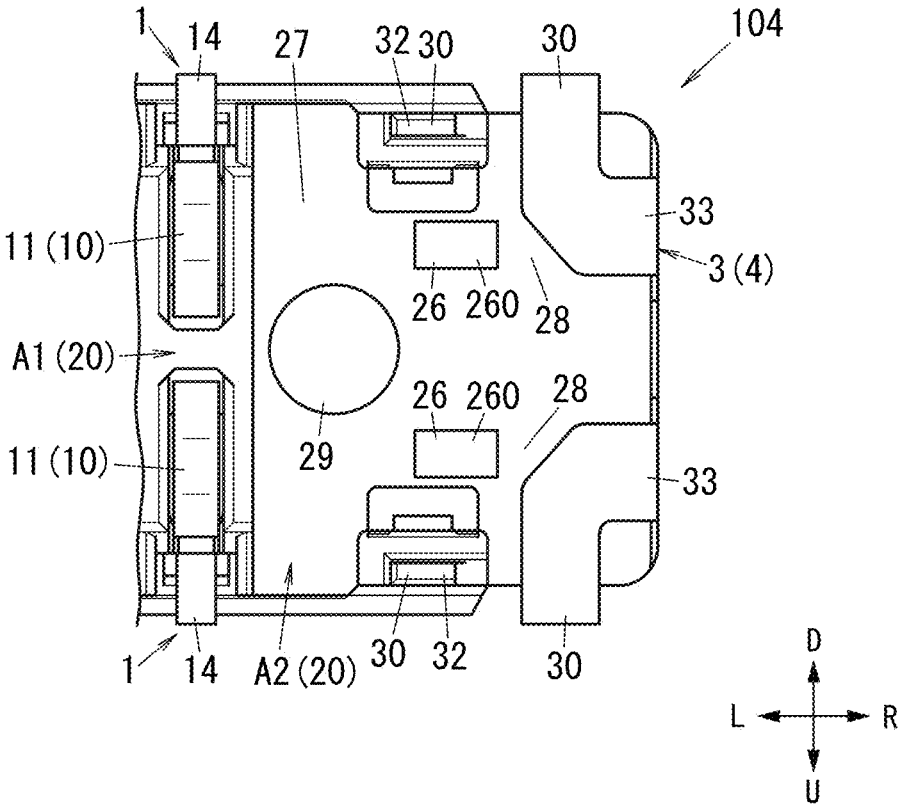
FIG. 14 is a back view of a connector as a fourth modified example according to Embodiment 1 of the present invention.

As shown in FIG. 14, the connector 104 as the fourth modified example according to the present embodiment is provided with a hollow 29 in each of two second region A2. Note that FIG. 14 shows only one end (right end) of a housing 2 in a lengthwise direction thereof. The hollow 29 that is circular in plan view is provided at a place of the second region A2, which allows an ejector pin to be pressed against. The hollow 29 is set further forward than a bottom of a corresponding recess 27. That is, in a state where the connector 104 is mounted on a substrate 5, a distance between the substrate 5 and the hollow 29 is longer than a distance between the substrate 5 and the corresponding recess 27. The hollow 29 is formed as a result of, for example the ejector pin being pressed against the above-mentioned place. Alternatively, the hollow 29 may be formed, for example by being molded by a mold.

The present modified example makes it possible to, when each mounting metal fitting 3 is joined to the substrate 5 by soldering, reduce the flow of flux 61 contained in solder 6 to contacts 1, like the present embodiment. Since the present modified example possesses the hollows 29, flux 61 hardly spreads in a place between the substrate 5 and each hollow 29.

(5.5) Fifth Modified Example

Figure 15:
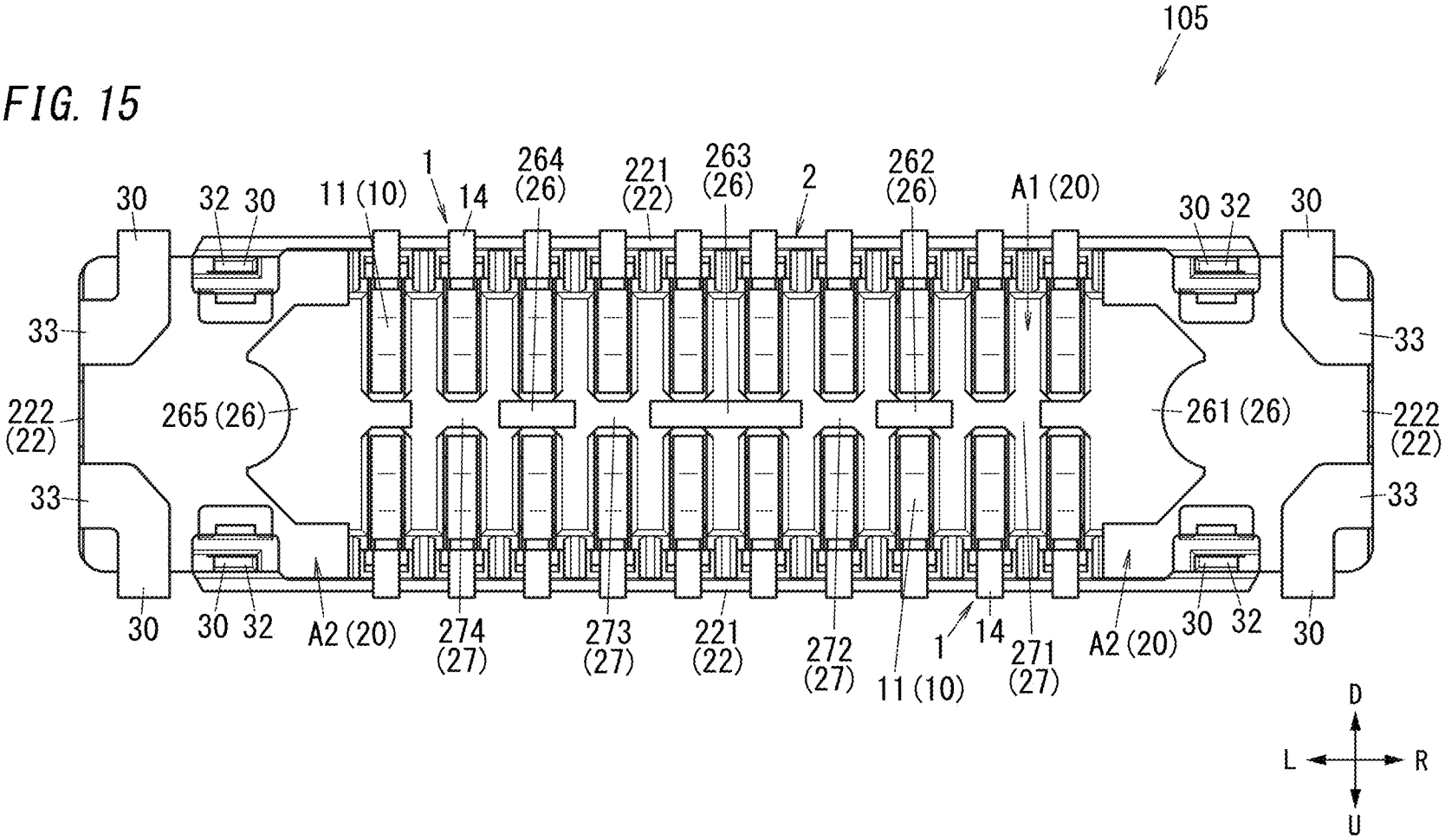
FIG. 15 is a back view of a connector as a fifth modified example according to Embodiment 1 of the present invention.

As shown in FIG. 15, the connector 105 as the fifth modified example according to the present embodiment possesses two or more (here, five) protrusions 26 and two or more (here, four) recesses 27. Each of the protrusions 26 has a rectangular shape in plan view, and is disposed at a place between upper contacts 1 and lower contacts 1 in the first region A1. Like the protrusions 26, the recesses 27 are disposed at a place between the upper contacts 1 and the lower contacts 1 in the first region A1. Note that the present modified example is formed with no step at respective boundaries between the first region A1 and the second regions A2.

The protrusions 26 and the recesses 27 in the present modified example are alternately arranged in an arrangement direction of the contacts 1 (the lateral direction). Herein, the protrusions 26 include a first protrusion 261, a second protrusion 262, a third protrusion 263, a fourth protrusion 264 and a fifth protrusion 265 in order from one end (right end) side of a housing 2 in a lengthwise direction thereof (the lateral direction). In addition, the recesses 27 include a first recess 271, a second recess 272, a third recess 273 and a fourth recess 274 in order from the one end side of the housing 2 in the lengthwise direction thereof.

In the present embodiment, each of the protrusions 26 is provided between joined sections 30 and part of respective exposed sections 10 of the contacts 1. For example, the first protrusion 261 is provided between right joined sections 30 and respective exposed sections 10 of remaining contacts 1 other than a pair of contacts 1, at a rightmost side, of the contacts 1. In the present embodiment, the recesses 27 is provided between the joined sections 30 and part of exposed sections 10 of the contacts 1. For example, the first recess 271 is provided between the first protrusion 261 and respective exposed sections 10 of remaining contacts 1 other than two pairs of contacts 1, at a rightmost side, of the contacts 1.

With the present modified example, a place between a substrate 5 and the first recess 271 in the proximity of the first protrusion 261 makes it hard that flux 61 spreads even if the flux 61 penetrates into a place between the first protrusion 261 and the substrate 5. In addition, a place between the substrate 5 and the second recess 272 in the proximity of the second protrusion 262 makes it hard that flux 61 spreads even if the flux 61 penetrates into a place between the substrate 5 and the second protrusion 262. Thus, the present modified example possesses the protrusions 26 and the recesses 27. Therefore, even if flux 61 penetrates into a place where part of the contacts 1 are disposed, the present modified example enables a reduction in the flow of flux 61 to a place where the remaining contacts 1 are disposed.

Embodiment 2

Figure 16:
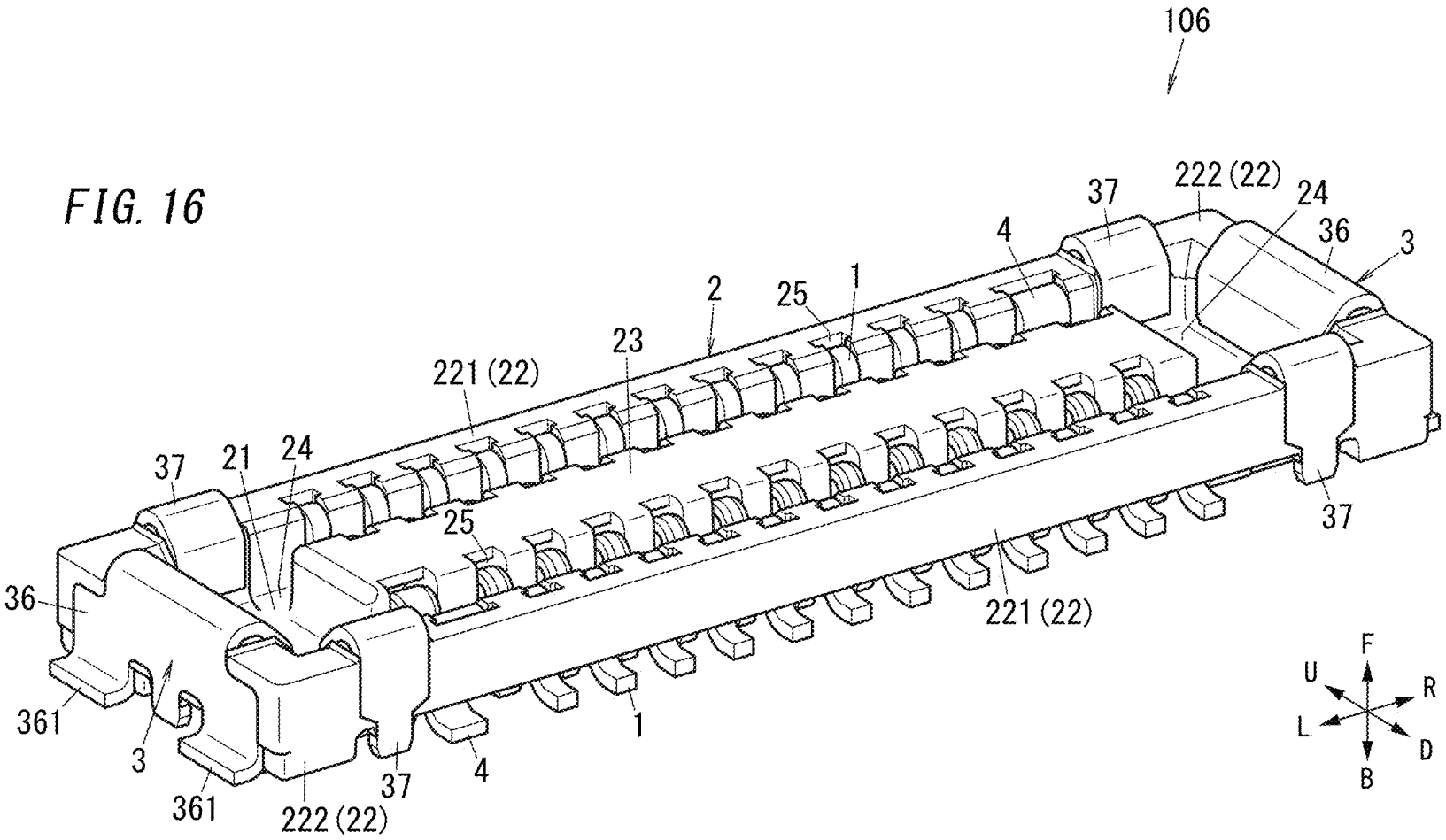
FIG. 16 is a perspective view of a connector according to Embodiment 2 of the present invention.
Figure 17:
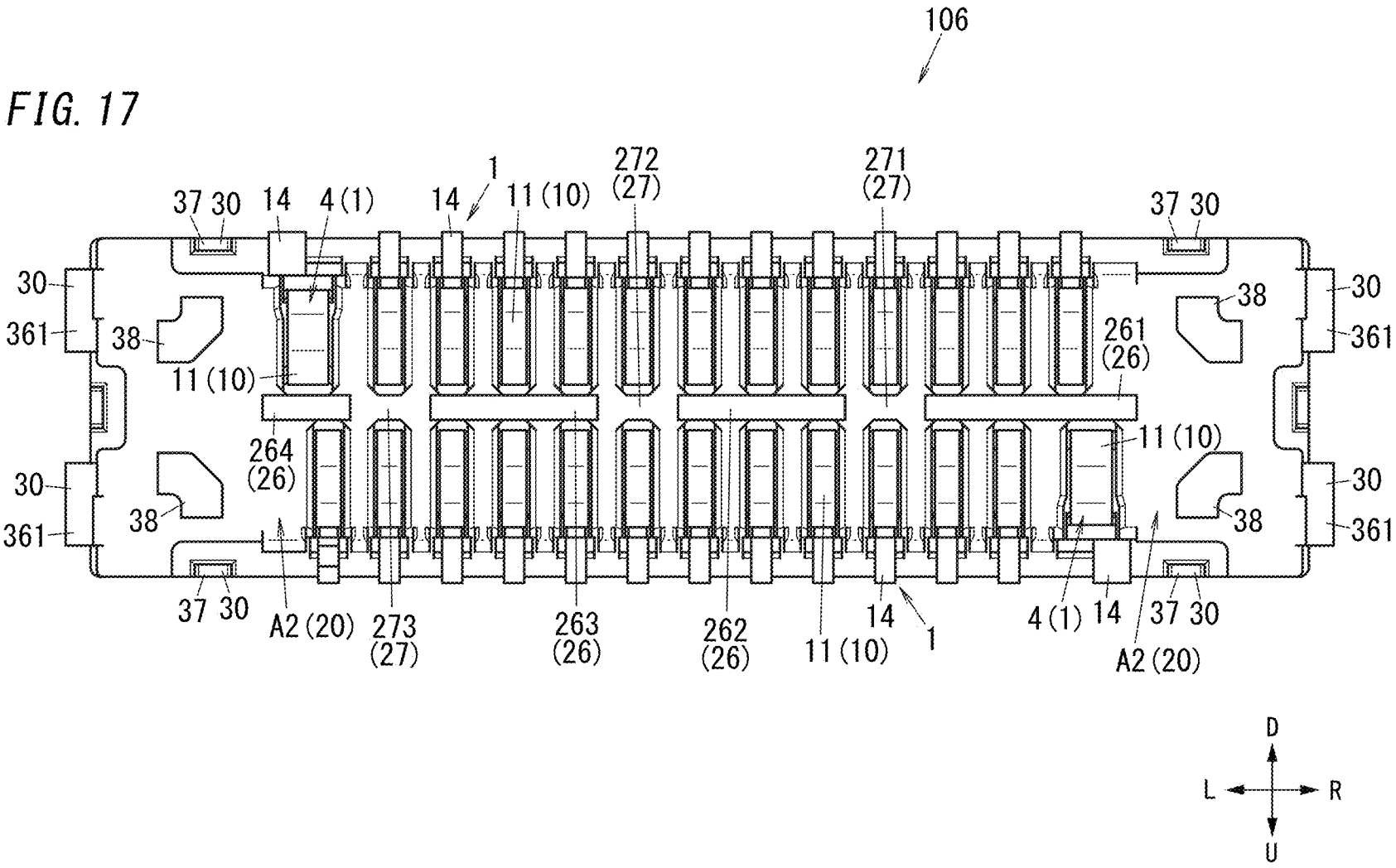
FIG. 17 is a back view of the connector.

A connector 106 according to Embodiment 2 will be explained below with reference to FIGS. 16 and 17. Note that the basic configuration of the connector 106 according to the present embodiment is similar to that of the connector 100 according to Embodiment 1, and therefore the description of common points will be omitted. In the connection system 300, the connector 106 according to the present embodiment may be employed in place of the connector 100 according to Embodiment 1.

The connector 106 according to the present embodiment possesses, as contacts 1, twenty-six contacts 1, unlike the connector 100 according to Embodiment 1. In addition, two contacts 1 of the contacts 1 in the present embodiment function as power supply terminals 4. Specifically, a rightmost contact 1 of contacts 1 disposed at an upper side of a base 23 and a leftmost contact 1 of contacts 1 disposed at a lower side of the base 23 function as the power supply terminals 4.

Here, a current flowing through each power supply terminal 4 is larger than a current flowing through each contact 1. Therefore, in the present embodiment, each width dimension of the contacts 1 as the power supply terminals 4 (a dimension in a lengthwise direction of a housing 2) is longer than each width dimension of the other contacts 1. Thus, respective impedance of the power supply terminals 4 are made smaller than respective impedance of the contacts 1.

Mounting metal fittings 3 in the present embodiment are different from the mounting metal fittings 3 in Embodiment 1. Specifically, each mounting metal fittings 3 in the present embodiment is composed of one main piece 36, a pair of side pieces 37 and a pair of connection pieces 38. In the explanation below, although a mounting metal fitting 3, to be attached to one end (left end) of the housing 2, of the pair of mounting metal fittings 3 will be explained as an example, another mounting metal fitting 3 to be attached to another end (right end) of the housing 2 also has a similar configuration thereto.

The main piece 36 is attached to a second side wall 222 that is one (left one) of a pair of second side walls 222. The main piece 36 is provided with a pair of joined pieces 361 at a back end edge thereof. The pair of joined pieces 361 is exposed from a bottom wall 21 of the housing 2 with the pair of joined pieces 361 bent in a direction (a left direction) along the bottom wall 21 from the back end edge of the main piece 36. Respective surfaces (back surfaces) of the pair of joined pieces 361 serve as joined sections 30 to be soldered onto a substrate 5.

A side piece 37 that is one (lower one) of the pair of side pieces 37 is attached to a place which is one end, in a lengthwise direction (the lateral direction), of a first side wall 221 that is one (lower one) of a pair of first side walls 221 and where no contacts 1 are disposed. A side piece 37 that is another (upper one) of the pair of side pieces 37 is attached to a place which is one end, in a lengthwise direction, of a first side wall 221 that is another (upper one) of the pair of first side walls 221 and where no contacts 1 are disposed. Respective back surfaces of the pair of side pieces 37 are exposed from the bottom wall 21 of the housing 2, and joined sections 30 that allowed to be soldered onto the substrate 5.

A connection piece 38 that is one (lower one) of the pair of connection pieces 38 connects the main piece 36 and a side piece 37 that is one (lower one) of the pair of side pieces 37. In addition, a connection piece 38 that is another (upper one) of the pair of connection pieces 38 connects the main piece 36 and a side piece 37 that is another (upper one) of the pair of side pieces 37. Respective parts of the pair of connection pieces 38 are exposed from the bottom wall 21 of the housing 2. Here, the respective parts of the pair of connection pieces 38 exposed from the bottom wall 21 in the present embodiment may serve as protrusions 26.

Besides the protrusions 26 composed of the connection pieces 38, the connector 106 according to the present embodiment possesses two or more (here, four) protrusions 26 and two or more (here, three) recesses 27. Each of the protrusions 26 has a rectangular shape in plan view, and is disposed at a place between upper contacts 1 and lower contacts 1 in a first region A1. The recesses 27 are disposed in the place between the upper contacts 1 and the lower contacts 1 in the first region A1. Note that the present embodiment is provided with no step at respective boundaries between the first region A1 and the second regions A2 in a back surface 20 of the housing 2.

The protrusions 26 and the recesses 27 in the present embodiment are alternately arranged in an arrangement direction of the contacts 1 (the lateral direction). Herein, the protrusions 26 include a first protrusion 261, a second protrusion 262, a third protrusion 263, and a fourth protrusion 264 in order from one end (right end) side of the housing 2 in the lengthwise direction thereof (the lateral direction). In addition, the recesses 27 include a first recess 271, a second recess 272, and a third recess 273 in order from the one end side of the housing 2 in the lengthwise direction thereof.

In the present embodiment, each of the protrusions 26 is provided between joined sections 30 and part of respective exposed sections 10 of the contacts 1. For example, the first protrusion 261 is provided between right joined sections 30 and respective exposed sections 10 of remaining contacts 1 other than a pair of contacts 1 (including one power supply terminal 4), at a rightmost side, of the contacts 1. In addition, the recesses 27 in the present embodiment are provided between the joined sections 30 and part of respective exposed sections 10 of the contacts 1. For example, the first recess 271 is provided between the first protrusion 261 and respective exposed sections 10 of remaining contacts 1 other than four pairs of contacts 1 (including one power supply terminal 4), at a rightmost side, of the contacts 1.

Advantages

The connector 106 according to the present embodiment makes it possible to, when each mounting metal fitting 3 is joined to the substrate 5 by soldering, reduce the flow of flux 61 contained in solder 6 to the contacts 1, like the connector 100 according to Embodiment 1. In the present embodiment, a place between the substrate 5 and the first recess 271 in the proximity of the first protrusion 261 in particular makes it hard that flux 61 spreads even if the flux 61 penetrates into a place between the first protrusion 261 and the substrate 5. In addition, a place between the substrate 5 and the second recess 272 in the proximity of the second protrusion 262 makes it hard that flux 61 spreads even if the flux 61 penetrates into a place between the second protrusion 262 and the substrate 5. Thus, the present embodiment possesses the protrusions 26 and the recesses 27. Therefore, even if flux 61 penetrates into a place where part of the contacts 1 are disposed, the present embodiment example makes it possible to reduce the flow of the flux 61 to a place where the remaining contacts 1 are disposed.

(3) Modified Example

Figure 18:
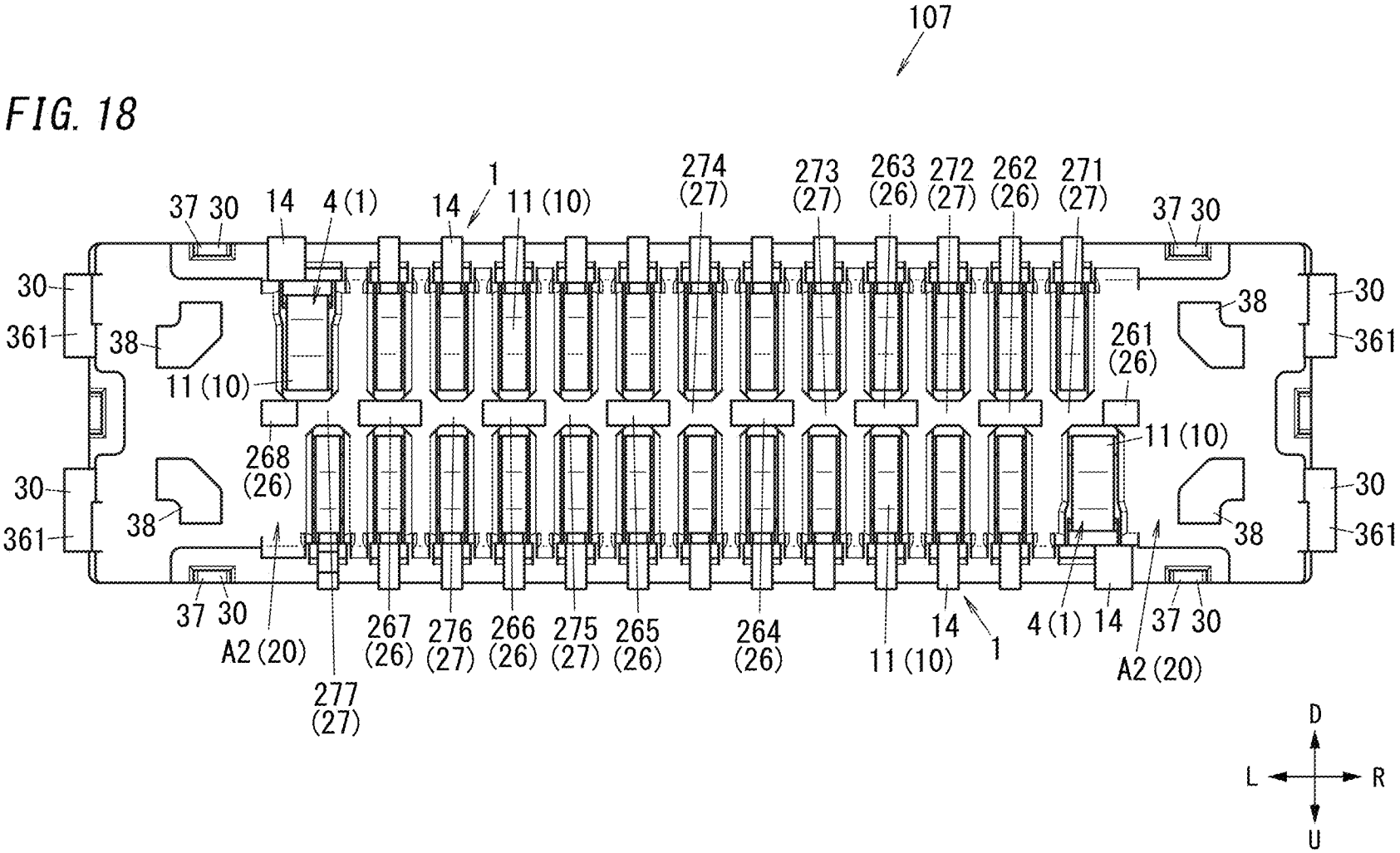
FIG. 18 is a back view of a connector as a modified example according to Embodiment 2 of the present invention.

A configuration of a connector 107 as a modified example of the present embodiment will be explained below with reference to FIG. 18. Note that the basic configuration of the connector 107 as the present modified example is similar to that of the connector 106 according to the present embodiment, and therefore the description of common points will be omitted. In the connection system 300, the connector 107 as the present modified example may be employed in place of the connector 100 according to Embodiment 1.

Besides protrusions 26 composed of connection pieces 38, the connector 107 as the present modified example possesses two or more (here, eight) protrusions 26 and two or more (here, seven) recesses 27. In the present modified example, the protrusions 26 are disposed at intervals in an arrangement direction of contacts 1 (the lateral direction) in every other contact 1. Similarly, the recesses 27 in the present modified example are disposed at intervals in the arrangement direction of contacts 1 in every other contacts 1. Herein, the protrusions 26 include first to eighth protrusions 261 to 268 in order from one end (right end) side of a housing 2 in a lengthwise direction thereof (the lateral direction). In addition, the recesses 27 include first to seventh recesses 271 to 277 in order from the one end side of the housing 2 in the lengthwise direction thereof.

With the connector 107 as the present modified example, respective intervals of the protrusions 26 and respective intervals of the recesses 27 are narrower than those of the connector 106 according to the present embodiment. It is accordingly possible to further reduce the flow of flux 61 to the contacts 1. For example, in the connector 106 according to the present embodiment, when flux 61 penetrates into a place between the first protrusion 261 and a substrate 5, the flux 61 may adhere to three pairs of contacts 1 (including one power supply terminal 4) at a rightmost side of the housing 2 and remain in this state. In contrast, in the above case, the connector 107 as the present modified example make it possible to, if flux 61 remains in a place between the substrate 5 and the first recess 271 in the proximity of the first protrusion 261, reduce the number of contacts 1 to which the flux 61 may adhere. That is, in the connector 107 as the present modified example, when the flux 61 remains as state above, the flux 61 may adhere only to a pair of contacts 1 (including one power supply terminal 4), at the rightmost side of the housing 2.

As stated above, a connector (100 to 107) according to a first aspect includes contacts (1), a housing (2) and a mounting metal fitting (3). The housing (2) retains the contacts (1). The mounting metal fitting (3) is attached to the housing (2). The mounting metal fitting (3) possesses a joined section (30) to be joined to a substrate (5). The joined section (30) is exposed from a back surface (20) of the housing (2) to face the substrate (5). Each of the contacts (1) possesses an exposed section (10) exposed from the back surface (20) of the housing (2). The housing (2) possesses a protrusion (26) and a recess (27). The protrusion (26) is provided between the joined section (30) and at least part of the exposed sections (10) of the contacts (1), and protrudes from the back surface (20). The recess (27) is provided between the protrusion (26) and at least part of the exposed sections (10) of the contacts (1), and is set lower than an end face (260) of the protrusion (26) to face the substrate (5).

This configuration makes it possible to, when the mounting metal fitting (3) is joined to the substrate (5) by soldering, reduce the flow of flux (61) contained in the solder (6) to the contacts (1).

In a second aspect according to the first aspect, the protrusion (26) in the connector (100 to 107) is provided between the joined section (30) and all the exposed sections (10) of the contacts (1). The recess (27) is provided between the protrusion (26) and all the exposed sections (10) of the contacts (1).

In this configuration, the protrusion (26) and the recess (27) are disposed outside a place where all the contacts (1) are disposed. It is accordingly possible to promise an advantage of reducing the flow of flux (61) to all the contacts (1).

In a third aspect according to the first aspect, the protrusion (26) in the connector (105, 106) is provided between the joined section (30) and part of the exposed sections (10) of the contacts (1). The recess (27) is provided between the protrusion (26) and part of the exposed sections (10) of the contacts (1).

In this configuration, the protrusion (26) and the recess (27) are disposed outside a place where part of the contacts (10) are disposed. It is accordingly possible to promise an advantage of reducing the flow of flux (61) to the part of the contacts (10).

In a fourth aspect according to the first aspect or the second aspect, the housing (2) in the connector (100-107) further possesses a fitting section (24) that allows a mating connector (200) to be fit in. The protrusion (26) is provided at a location of the back surface (20) corresponding to the fitting section (24).

The protrusion (26) in this configuration makes it possible to reinforce part of the back surface (20) of the housing (2) to be in contact with the mating connector (200). The configuration therefore enables reduction in subsidence of the part of the back surface (20) of the housing (2) in contact with the mating connector (200), caused by being pressed with the mating connector (200) when the mating connector (200) is fit in the connector (100 to 107).

In a fifth aspect according to any of the first to fourth aspects, a protrusion dimension of the joined section (30) from the back surface (20) in the connector (100 to 107) is equal to or greater than a protrusion dimension of the protrusion (26) from the back surface (20).

With this configuration, for example, if spreading a place between the substrate (5) and the protrusion (26), the place between the substrate (5) and the protrusion (26) can make it hard that flux (61) spreads.

In a sixth aspect according to any of the first to fifth aspects, the protrusion (26) in the connector (100 to 107) may be made of the same material as the housing (2).

This configuration enables employing part of the housing (2) as the protrusion (26). Therefore, with the configuration, for example, the protrusion (26) can be provided only by molding the housing (2) by using a mold, thereby simplifying the manufacture of the connectors (100 to 107).

In a seventh aspect according to any of the first to fifth aspects, the protrusion (26) in the connector (100 to 107) may be made of the same material as the mounting metal fitting (3).

This configuration enables employing part of the mounting metal fitting (3) as the protrusion (26). Therefore, with the configuration, for example, the protrusion (26) can be provided only by insert molding the housing (2) along with the mounting metal fitting (3) as an inserted component, thereby simplifying the manufacture of the connectors (100 to 107).

In an eighth aspect according to any of the first to seventh aspects, the housing (2) in the connector (100 to 107) further possesses a groove (28). The groove (28) is provided between the joined section (30) and the protrusion (26) and is lower than the end face (260) of the protrusion (26).

With this configuration, a place between the substrate (5) and the groove (28) is thicker than a place between the substrate (5) and the protrusion (26). The place between the substrate (5) and the groove (28) therefore makes it hard that a capillary phenomenon and the like occur. The configuration therefore makes it possible to more reduce the flow of flux (61) to the contacts (1) than a configuration in which no groove (28) is provided between the joined section (30) and the protrusion (26) does.

In a ninth aspect according to any of the first to eighth aspects, the connector (104) includes, as the protrusion (26), a pair of protrusions (26). The housing (2) further possesses a hollow (29). The housing (2) is provided between the pair of protrusions (26) and is lower than respective end faces (260) of the protrusions (26).

With this configuration, a place between the substrate (5) and the hollow (29) is thicker than a place between the substrate (5) and the recess (27). It is accordingly possible to reduce the spread of flux (61) at the place between the substrate (5) and the hollow (29).

In a tenth aspect according to any of the first to ninth aspects, the connector (105 to 107) includes, as the protrusion (26) and the recess (27), protrusions (26) and recesses (27), respectively. The protrusions (26) and the recesses (27) are alternately arranged in an arrangement direction of the contacts (1).

This configuration makes it possible to, even if flux (61) penetrates into a place where part of the contacts (1) are disposed, reduce the flow of the flux (61) to a place where the remaining contacts (1) are disposed.

A connection system (300) according to an eleventh aspect includes a connector (100 to 107) according to any of the first to tenth aspects, and a mating connector (200). The mating connector (200) possesses mating contacts (1A) electrically connected with the contacts (1).

The connection system (300) realized by this configuration makes it possible to, when the mounting metal fitting (3) is joined to the substrate (5) by soldering, reduce the flow of flux (61) contained in the solder (6) to the contacts (1).

The connectors 100 to 107 and the connection system 300 according to Embodiments 1 and 2 have been described above. Note that each embodiment describe above is merely one of various embodiments of the present invention. In the embodiments described above, various modifications may be made according to general arrangement and the like as long as the object of the present invention can be achieved.

REFERENCE SIGNS LIST

1 Contact
10 Exposed section
2 Housing
20 Back surface
24 Fitting section
26 Protrusion
27 Recess
28 Groove
29 Hollow

3 Mounting metal fitting
30 Joined section
100 to 107 Connector
200 Mating connector
300 Connection system

The invention claimed is:

1. A connector, comprising
contacts,
a housing in which at least some of the contacts are aligned in a longitudinal direction, and
a mounting metal fitting attached to one longitudinal end of the housing,
the mounting metal fitting including a joined section to be joined to a substrate, the joined section being exposed from a back surface of the housing to face the substrate, wherein
each of the contacts includes an exposed section exposed from the back surface of the housing, and
the housing includes:
a first protrusion and a second protrusion that protrude from the back surface of the housing and are made from resin material, and
a recess is: (i) set lower than both an end face of the first protrusion that faces the substrate and an end face of the second protrusion that faces the substrate and (ii) is formed on the back surface of the housing,
wherein at least a portion of the first protrusion is provided between the joined section and the exposed section of a particular one of the contacts, the particular one of the contacts being located closer to the one longitudinal end of the housing than any other one of the contacts,
wherein, with respect to the longitudinal direction, at least a portion of the second protrusion is provided between a first boundary and a second boundary,
the first boundary defined by a first straight line that intersects the longitudinal direction with respect to a plan view of the first and second protrusions, the first boundary passing through the exposed section of the particular one of the contacts,
the second boundary defined by a second straight line that intersects the longitudinal direction with respect to the plan view, the second boundary passing through the exposed section of one of the contacts that is located closest to another end of the housing in the longitudinal direction,
the recess, with respect to the longitudinal direction, includes:
a first recessed region at least partially provided between the first protrusion and one of the exposed sections of the contacts; and
a second recessed region at least partially provided between the first protrusion and the second protrusion.

2. The connector of claim 1, wherein
the recess includes a portion provided between the first protrusion and the exposed section of the particular one of the contacts that is located closer to the one longitudinal end than any other one of the contacts.

3. The connector of claim 1, wherein
the housing further includes a fitting section that allows a mating connector to be fit in, and
the first protrusion is provided at a location of the back surface corresponding to the fitting section.

4. The connector of claim 1, wherein a protrusion dimension of the joined section from the back surface is equal to or greater than a protrusion dimension of the first protrusion from the back surface.

5. The connector of claim 1, wherein the first protrusion is made of the same material as the housing.

6. The connector of claim 1, wherein the housing further includes a groove that is provided between the joined section and the first protrusion and lower than the end face of the first protrusion.

7. The connector of claim 1, wherein the first protrusion comprises a pair of protrusions,
the housing further includes a hollow that is provided between the pair of protrusions and is lower than respective end faces of the pair of protrusions.

8. The connector of claim 1, wherein
the first protrusion and the second protrusion are arranged in the longitudinal direction.

9. The connector of claim 1, wherein
the second protrusion includes two protrusions, and the housing further includes a depression that is provided on the back surface of the housing between the two protrusions of the second protrusion and that is set lower than the end face of the second protrusion to face the substrate.

10. The connector of claim 9, wherein
the two protrusions of the second protrusion are aligned in the direction in which the contacts are aligned.

11. The connector of claim 9, wherein
at least a portion of the first protrusion is provided at the first boundary and protrudes from the back surface.

12. The connector of claim 1, wherein
the second protrusion includes:
a first portion provided at the first boundary and protruding from the back surface; and
a second portion connected to the first portion and provided at the second boundary so as to protrude from the back surface.

13. The connector of claim 1, wherein
at least a portion of the first protrusion is provided at the first boundary and protrudes from the back surface.

14. A connection system, comprising
a connector of claim 1, and
a mating connector including mating contacts electrically connected with the contacts.

* * * * *